US012066278B2

(12) United States Patent
Sprague et al.

(10) Patent No.: US 12,066,278 B2
(45) Date of Patent: Aug. 20, 2024

(54) TRIGGERING EXPLOSIVES IN HOLES

(71) Applicant: Olitek Pty Ltd, Northgate (AU)

(72) Inventors: Anthony James Sprague, Melbourne (AU); James Thomas Oliver, Melbourne (AU); Stephen Hanwright, Queensland (AU)

(73) Assignee: Newcrest Mining Limited, Melbourne (AU)

( * ) Notice: Subject to any disclaimer, the term of this patent is extended or adjusted under 35 U.S.C. 154(b) by 172 days.

(21) Appl. No.: 17/612,702

(22) PCT Filed: May 21, 2020

(86) PCT No.: PCT/AU2020/050500

§ 371 (c)(1),
(2) Date: Nov. 19, 2021

(87) PCT Pub. No.: WO2020/232506

PCT Pub. Date: Nov. 26, 2020

(65) Prior Publication Data

US 2022/0282958 A1 Sep. 8, 2022

(30) Foreign Application Priority Data

May 21, 2019 (AU) ..... 2019901712
Aug. 1, 2019 (AU) ..... 2019902752

(51) Int. Cl.
*F42B 3/02* (2006.01)
*E21C 37/00* (2006.01)
(Continued)

(52) U.S. Cl.
CPC ..... *F42B 3/02* (2013.01); *E21C 37/00* (2013.01); *E21D 9/006* (2013.01); *F42B 3/10* (2013.01);
(Continued)

(58) Field of Classification Search
CPC ..... F42B 3/02; F42B 3/10; F42B 3/26; F42D 1/02; F42D 1/08
See application file for complete search history.

(56) References Cited

U.S. PATENT DOCUMENTS 4,040,329 A 8/1977 Ljungberg
5,614,693 A * 3/1997 Welch ..... F42B 3/10 102/318
(Continued)

FOREIGN PATENT DOCUMENTS

WO 2011117394 A1 9/2011
WO 0060301 A1 10/2020

OTHER PUBLICATIONS

International Search Report dated Jul. 31, 2020 pertaining to PCT Application No. PCT/AU2020/050500 filed May 21, 2020.
(Continued)

*Primary Examiner* — Bret Hayes
(74) *Attorney, Agent, or Firm* — Dinsmore & Shohl LLP

(57) ABSTRACT

An assembly (7) for triggering an explosive in a hole (9) to produce an explosive blast in the hole includes (a) an explosion trigger (15, 19) for triggering the explosive in the hole, (b) a detonation unit body (21) that is configured to be located at or proximate an open end of the hole in an initial position of the assembly in the hole and (c) a trigger cord (31) that is connected to the detonation unit body and to the explosion trigger.

17 Claims, 18 Drawing Sheets

(51) Int. Cl.

| | |
|---|---|
| ***E21D 9/00*** | (2006.01) |
| ***F42B 3/10*** | (2006.01) |
| ***F42B 3/26*** | (2006.01) |
| ***F42D 1/02*** | (2006.01) |
| ***F42D 1/08*** | (2006.01) |

(52) U.S. Cl.
CPC ..... *F42B 3/26* (2013.01); *F42D 1/02* (2013.01); *F42D 1/08* (2013.01)

(56) References Cited

U.S. PATENT DOCUMENTS

| | | | | |
|---|---|---|---|---|
| 6,497,180 | B1 * | 12/2002 | Martin | F42B 3/125 102/202.7 |
| 2005/0161257 | A1 | 7/2005 | Finden et al. | |
| 2009/0223400 | A1 * | 9/2009 | Hill | F42D 1/055 102/202.7 |
| 2012/0192748 | A1 * | 8/2012 | Scheid | F42B 3/26 403/221 |
| 2013/0206027 | A1 | 8/2013 | Bengtsson | |
| 2017/0184379 | A1 * | 6/2017 | Barzilai | F42D 3/00 |
| 2018/0202780 | A1 | 7/2018 | Boos et al. | |
| 2018/0231361 | A1 | 8/2018 | Wicks et al. | |

OTHER PUBLICATIONS

International-Type Search Report dated Aug. 29, 2019 pertaining to Australian Application No. 2019902752 filed Aug. 1, 2019.

* cited by examiner

TRIGGERING EXPLOSIVES IN HOLES

CROSS REFERENCES TO RELATED APPLICATIONS

This application is a national-stage application under 35 U.S.C. § 371 of International Application No. PCT/AU2020/050500, filed May 21, 2020, which International Application claims benefit of priority to Australian Patent Application No. 2019901712, filed May 21, 2019, and to Australian Patent Application No. 2019902752, filed Aug. 1, 2019.

TECHNICAL FIELD

The invention relates to triggering explosives in holes that enables process mechanisation, remote loading and autonomous loading.

The invention relates generally to triggering explosives in holes in underground and above-ground mines and in civil engineering applications, such as tunnels.

The invention relates particularly, although by no means exclusively, to triggering explosives in holes in underground mines, such as:

(a) in the development of horizontally-extending tunnels in underground mines for the purpose of blasting rock and extending the tunnels, or (b) for mine production purposes that require explosives and detonators to be placed in a combination of angled, horizontal or vertical for the purpose of blasting rock (e.g. stoping/block caves development/infrastructure development etc.

The invention also relates to a method for loading explosives and explosion triggers into holes.

The invention also relates to a method of blasting.

BACKGROUND

The following description of the invention is in the context of extending underground mine tunnels.

However, it is emphasised that the invention is not limited to this application and extends generally to positioning and detonating explosives in holes in any above-ground and below-ground applications, including the applications mentioned in paragraph (b) above, and also including by way of example civil tunnelling applications.

For a variety of reasons, there is a need to remove manual processes and personnel from the task of explosive loading and triggering explosives in blast holes in underground mine tunnels. This process is challenging as there is limited space in underground mine tunnels and the limited space has an impact on the development of mine tunnels. To enable mechanisation, remote loading and autonomous applications in explosive loading and triggering explosives, there is a need for a new method and an apparatus for loading explosives and triggering explosives in holes.

The conventional approach for extending underground mine tunnels is to drill a plurality of holes into an end face (mine face) of a tunnel, position explosives (typically but not limited to emulsion explosives) and electric or non-electric detonators in the holes and trigger the explosives via an external trigger system and produce explosive blasts, for reference an example of underground tunnel advancement (development) blast may fracture up to 200-400 tonnes of rock for extraction. There may be 40-60 or more drilled holes for loading explosives per blast. There is a need to control triggering explosives in the holes to achieve a required blast outcome.

The underground charge-up processes currently include a physical connection via a trigger cord (such as a detonator cord, electrical wire or non-electric shock tube e.g. in the form of a small diameter tube for transporting an initiation signal to explosives by means of a percussive wave travelling the length of the tube) or a chemical reaction connection between the external trigger system and (a) the explosives in a hole or (b) an explosion trigger (which could be described as an explosion initiator), such as a detonator or a combination of a detonator and a small explosive charge, such as a booster, positioned in the hole. The term "small" means small in comparison with the main body of blast-generating explosives in a hole.

The detonator and the small explosive charge, such as a booster, may be separate components or a single assembly. Typically, in underground mine tunnel charging, these holes range from 3-6 m deep and, as noted above, the number of holes is typically around 40-60 holes. The number of holes depends on the area of the end face (nominal 6 m×6 m @ 50-60 holes). The hole size is typically 45-50 mm diameter, but the size could be larger or smaller depending on application and/or explosive product used.

A challenge with mechanized, remote or automated charge loading systems for explosion triggers, such as a booster and a detonator assembly, is in the placement of an explosion trigger in a hole at a required location along the length of the hole without physical, i.e. direct, personnel intervention. The selected explosion trigger location may be at an end or part way along the length of the hole. Current standards dictate that different classes of explosives must not be in intimate contact (assembled) until immediately before insertion into a hole. Typically, in situations where the explosion trigger is boosters and detonators, these components are different explosive classes and must be assembled immediately before insertion into the hole.

Insertion and connection of explosion triggers and trigger cords (typically, a two-wire system for explosion triggers, but could also be non-electric shock tube or a chemical reaction connection) is difficult with a machine-based loading system, as there is lack of dexterity that a human operator offers, and that is generally required, during the conventional loading process. Additionally, careful management of 40-60 loose detonator cords or other trigger cords (typically, a two-wire system, but could also be non-electric shock tube) protruding from charged blast holes in the face is difficult with a machine-based loading system for explosion triggers.

The invention provides a method and an apparatus for triggering explosives in holes in both surface and underground mines that is an alternative to current practices.

The above description is not an admission of the common general knowledge in Australia and elsewhere.

Unless defined otherwise, all technical and scientific terms used herein have the same meaning as commonly understood by one of ordinary skill in the art to which this invention belongs. Although any methods, vehicles and other equipment and devices, and materials similar or equivalent to those described herein can also be used in the practice or testing of the present invention, a limited number of the exemplary methods, vehicles and other equipment and devices, and materials are described herein.

SUMMARY OF THE INVENTION

In broad terms, the invention provides an assembly for triggering an explosive in a hole to produce an explosive blast in the hole, with the assembly including (a) an explosion trigger for triggering the explosive in the hole, (b) a detonation unit body that is configured to be located at or proximate an open end of the hole and (c) a trigger cord that is connected to the detonation unit body and to the explosion trigger.

As noted above, the invention relates generally to triggering explosives in holes in underground and above-ground mines and in civil engineering applications, such as tunnels.

An important feature of the invention is that the trigger assembly is well-suited for placement in a drilled hole via a machine-based loading system for explosion triggers and for facilitating accurate placement of an explosion trigger in the hole.

Another important feature of the invention is that the detonation unit body of the trigger assembly is configured to be located at or proximate the open end of the hole and has one end of the trigger cord connected to it. As a consequence, that end of the trigger cord can be conveniently tied-in to an external detonation activation system (for example, connected via wireless or by hard wired connections) for the plurality of holes in the mine face. The invention is a departure from the current series of wires extending from drilled holes.

The explosive may be any suitable explosive.

For example, the explosive may be an emulsion explosive that is pumped into the hole.

By way of further example, the explosive may be a prepackaged explosive in cartridges.

The term "explosion trigger" is understood herein to mean any suitable device for triggering an explosion of an explosive in a hole.

The explosion trigger may include, by way of example, any one of (i) a detonator for triggering the explosive in the hole directly and (ii) a combination of a detonator and a small explosive charge, such as in a booster, for triggering the explosive in the hole.

In the case of item (i), in use, the detonator is activated, typically by an external detonation activation system (connected via wireless or by hard wired connections) and detonates the explosive in the hole.

In the case of item (ii), in use, the detonator is activated, typically by an external detonation activation system (for example, connected via wireless or by hard wired connections) and detonates the small explosive charge and this explosion detonates the explosive in the hole.

The trigger cord may include any one of a detonator cord, an electrical wire, a non-electric shock tube such as a mechanical shock tube, or a chemical reaction connection. By way of example, the trigger cord may be a fibre optic cord. It is understood form these examples that the word "cord" should be construed broadly in the context of the term "trigger cord".

The trigger assembly may be configured to be positioned in the hole at the open end of the hole in an initial position of the trigger assembly in the hole.

The detonation unit body may have a compartment for housing the explosion trigger in the initial position of the trigger assembly in the hole. The invention is not confined to this arrangement and extends to other arrangements, such as arrangements in which the explosion trigger is not housed in the compartment in the initial position of the trigger assembly in the hole.

The trigger assembly may be configured so that the explosion trigger can be moved forward into the hole from the initial position of the trigger assembly in the hole to a desired detonation position in the hole from the initial position of the trigger assembly in the hole, while the detonation unit body remains in the initial position (at or near the opening of the hole) and the trigger cord unwinds and maintains a physical connection between the detonation unit body and the explosion trigger so that the explosion trigger can be activated to trigger the explosive in the hole and produce an explosive blast.

Movement of a pushing device such as but not limited to an emulsion charging hose into the hole to supply explosive to the hole is one option for moving the explosion trigger forward to the detonation position.

Another option of a pushing device is a series of prepackaged cartridges of explosive that are pushed into the hole.

The detonation unit body may include a sleeve that defines the compartment and that is configured to extend into the hole and to receive and support and protect the explosion trigger in the initial position of the assembly in the hole.

The sleeve may be configured to support the trigger cord within or on the outside of the sleeve in the initial position of the assembly in the hole.

The detonation unit body may include a retaining means for retaining the detonation unit body at or proximate the open end of the hole.

By way of example, the retaining means may be a collar at one end of the sleeve that is configured to be located against the mine face of the rock mass in which the hole is formed and to prevent further insertion of the detonation body into the hole, with the sleeve extending into the hole.

The retaining means may be any other suitable retaining means.

For example, the retaining means may be a biasing member that is biased to engage a side wall of the hole and to retain the detonation unit body at or proximate the open end of the hole.

The detonation unit body may include a connection unit for providing a connection between the trigger cord and an external detonation activation system.

The detonation unit body may include a mount that receives and supports the explosion trigger within the sleeve in the initial position of the trigger assembly in the hole.

In one embodiment of the trigger assembly, the detonation unit body includes:

(a) a sleeve that defines the compartment and that is configured to extend into the hole and to receive and support and protect the explosion trigger within the sleeve in the initial position of the assembly in the hole;

(b) a retaining means (such as a collar at one end of the sleeve that is configured to be located against a mine face of the rock mass in which the hole is formed) for retaining the detonation unit body in the initial position of the trigger assembly in the hole, with the sleeve extending into the hole and the explosion trigger housed within the sleeve in the hole;

(c) a connection unit for providing a connection between the trigger cord and an external detonation activation system; and (c) a mount that receives and supports the explosion trigger within the sleeve in the initial position of the trigger assembly in the hole.

In one embodiment of the trigger assembly, the trigger cord is connected at one end to the explosion trigger and at the other end to the connection unit of the collar, and with the length of the trigger cord being selected to be at least the spacing between the explosion trigger and the connection piece when the explosion trigger is in the detonation position in the hole.

In one embodiment of the trigger assembly, the explosion trigger includes (a) a booster that contains a small explosives charge and (b) a detonator for detonating the small explosive charge, and the detonation unit body is configured to house and support the booster and the detonator, and the trigger cord is connected to the detonation unit body and to the explosion trigger.

With this embodiment, the trigger assembly is configured so that, in use, the booster and the detonator of the explosion trigger can be moved forward into the hole to a detonation position in the hole, while the detonation unit body remains in the initial position of the assembly in the hole and the trigger cord extends from the detonation unit body and remains connected to the detonator.

An internal wall of the sleeve of the detonation unit may include a channel, such as a spiral-shaped channel, which locates the trigger cord within the sleeve, for example in in a spiral arrangement, when the assembly is in the initial position in the hole.

The internal wall of the sleeve of the detonation unit body may include an axially-extending channel that receives a length of the trigger cord that connects the connection cord to the connection unit.

The booster and the detonator of the explosion trigger may be separate components in the initial position of the trigger assembly in the hole.

The booster and the detonator of the explosion trigger may be an assembly of the two components in the initial position of the trigger assembly in the hole.

The detonation unit body may also include a formation, for example in the form of a wall, at a forward end of the sleeve in the direction of insertion of the trigger assembly into the hole that at least partially closes the forward end of the sleeve and is configured to be detached from the sleeve when a force in excess of a threshold force is applied to the formation.

With this arrangement, when the booster and the detonator are housed in the sleeve in the initial position of the trigger assembly in the hole, the formation is a barrier to movement of the trigger assembly from within the sleeve via the forward end of the sleeve.

The detonator may be positioned ahead of the booster within the sleeve in the direction of insertion of the trigger assembly into the hole.

The detonation unit body may include formations on an internal wall of the sleeve that hold the booster within the sleeve so that there is an axial gap between the booster and the detonator in the initial position of the trigger assembly in the hole as a safety measure.

The arrangement may be such that there is a friction-fit between the formations and the booster that holds the booster spaced axially from the detonator in the initial position of the trigger assembly in the hole.

The detonator may be an elongate element.

The mount may be positioned at the forward end of the sleeve and supports the detonator to extend rearwardly into the sleeve towards a rearward end of the sleeve (in relation to insertion of the trigger assembly in the hole), with the booster positioned closer to the rearward end of the sleeve in the initial position of the trigger assembly in the hole.

With this arrangement, the booster may include an elongate chamber for receiving the detonator, with the detonator and the booster of the explosion trigger being configured so that the detonator and the booster are aligned axially in the elongate chamber and are spaced apart axially in the initial position of the trigger assembly in the hole, and with the detonator and the booster being configured so that the detonator can be received and housed in the elongate chamber when the booster is moved forwardly (in the direction of insertion of the assembly into the hole) towards the detonator.

In an alternative embodiment, the booster may be positioned ahead of the detonator within the sleeve in the direction of insertion of the trigger assembly into the hole.

The external detonation activation system may be any suitable system.

By way of example, the external detonation activation system may be located on a loading machine or another machine and can be initiated after all holes are loaded. The external activation system may be a wireless system. By way of further example, the external activation system may rely on a hard-wired connection.

The invention also provides a detonation unit body of an assembly for triggering explosives in a hole that includes:

(a) a sleeve that is configured to extend into the hole and to receive and support an explosion trigger and a trigger cord of the assembly within the sleeve in an initial position of the trigger assembly in the hole;

(b) a retaining means (such as a collar at one end of the sleeve that is configured to be located against a mine face of the rock mass in which the hole is formed) for retaining the detonation unit body in the initial position of the trigger assembly in the hole, with the sleeve extending into the hole and the explosion trigger and the trigger cord housed within the sleeve in the hole, and (c) a connection unit for providing a connection between the trigger cord and an external detonation activation system; and (d) a mount for receiving and supporting the explosion trigger within the sleeve.

An internal wall of the sleeve of the detonation unit body may include a spiral-shaped channel for locating the trigger cord in a spiral arrangement within the sleeve when the trigger assembly is in the initial position in the hole.

The internal wall of the sleeve may include an axially-extending channel for receiving a length of the trigger cord for connecting the trigger cord to the connection unit.

The detonation unit body may include a formation, for example in the form of a wall, at the opposite end of the sleeve to the collar, i.e. at a forward end of the sleeve in the direction of insertion of the trigger assembly into the hole, that at least partially closes the forward end of the sleeve and prevents forward movement of the explosion trigger and is configured to be detached from the sleeve when a force in excess of a threshold force is applied to the formation.

With this arrangement, the sleeve and the formation can receive and support the explosion trigger, with the formation being a barrier to movement of the explosion trigger from the unit.

In an embodiment in which the explosion trigger is in the form of (a) a booster containing a small charge of an explosive and (b) a detonator for the explosive charge in the booster, the detonation unit body may include formations on an internal wall of the sleeve for holding the booster within the sleeve so that there is an axial gap between the booster and the detonator in the initial position of the trigger assembly in the hole.

The arrangement may be such that there is a friction-fit between the formations and the booster that holds the booster spaced axially from the detonator in the initial position of the trigger assembly in the hole.

The invention also provides an apparatus for loading explosives and detonators into holes including:

(a) a plurality of the above-described assemblies for triggering an explosion of an explosives material in a hole, each assembly including an explosion trigger, a detonation unit body, and a trigger cord; and (b) an explosives delivery vehicle for delivering a trigger assembly into the hole, the vehicle comprising:

(i) a storage assembly for storing a plurality of the trigger assemblies;

(ii) a loading assembly for supporting one of the trigger assemblies in a delivery position in relation to the hole and for moving the trigger assembly into the hole to be located at an open end of the hole in an initial position of the trigger assembly;

(iii) an insertion device for contacting and moving the explosion trigger forward into the hole forwardly of the detonation unit body.

The explosives delivery vehicle may be any suitable vehicle.

The explosives delivery vehicle may also include a system for locating the vehicle in a loading location in relation to a hole.

The insertion device may be an emulsion charge hose.

In an embodiment in which the explosion trigger is in the form of (a) a booster containing a small charge of an explosive and (b) a detonator for the explosive charge in the booster that are spaced apart axially within the detonation unit body, the emulsion explosive charging hose is configured to contact and move the booster forwardly so that the booster receives the detonator and forms a booster/detonator assembly and then moves the booster/detonator assembly into the hole forwardly of the detonation unit body.

The insertion device may be a member that can be moved axially between a retracted position in which the member supports a rear end of a loaded trigger assembly and an extended position in which the member has moved the trigger assembly into and retains the trigger assembly in the initial position in the hole.

With this arrangement, the insertion device may also include an emulsion charging hose for contacting and moving the explosion trigger forward from the initial position into the hole forwardly of the detonation unit body.

The member may be a tube.

The emulsion charging hose may be configured to extend through the tube.

The invention provides a method for loading explosives and explosion triggers into holes, the method including, for each hole:

(a) locating one of the above-described trigger assemblies in the initial position of the trigger assembly in the hole, (b) moving the explosion trigger of the trigger assembly forward to a detonation position in the hole from the initial position of the trigger assembly in the hole; and (c) locating an explosive in the hole.

Step (b) of the method may include inserting an emulsion charging hose into the hole to move the explosion trigger of the trigger assembly forward to the detonation position in the hole from the initial position of the trigger assembly in the hole.

Step (b) may include any other suitable option for moving the explosion trigger forward to the detonation position.

The method may include positioning a vehicle that stores explosives.

The invention also provides a method of blasting rock, the method including:

(a) positioning a vehicle that stores a plurality of the above-described trigger assemblies in relation to rock to be blasted;

(b) locating assemblies in holes in the rock in accordance with the above-described method for loading explosives and explosion triggers into holes;

(c) tying-in the explosion triggers; and (d) initiating explosions in the holes.

The vehicle may be the same vehicle that stores explosives.

The method may include the following embodiments.

Method 1 Embodiment the explosion trigger is in the form of (a) a booster containing a small explosive charge and (b) a detonator for the small explosive charge.

1. A purpose-built machine (such as a vehicle) separately stores (a) a plurality of the boosters and (b) a plurality of assemblies of the detonation unit body and the detonator housed in the detonation unit body, with the trigger cord interconnecting the detonation unit body and the detonator in each assembly.

2. When a trigger assembly is required for a hole, and the machine is positioned in an aligned position to insert a trigger assembly into the hole, the machine removes (a) a booster and (b) an assembly of the detonation unit body and the detonator from the separate storage locations and positions the booster into the sleeve of the detonation unit body with an axial gap between the booster and the detonator, thereby forming the trigger assembly.

3. The machine deploys the trigger assembly into the hole to the initial position of the trigger assembly in the hole, with the retaining means (such as the collar of the detonation unit body contacting the mine face of the rock mass in which the hole is formed) retaining the detonation unit body at or proximate the open end of the hole, thereby locating the trigger assembly in the initial position of the assembly in the hole. Typically, the machine includes an insertion device to support the trigger assembly in a loading position and to move the trigger assembly forward to locate the trigger assembly in the initial position in the hole.

4. The machine then drives a pushing device such as but not limited to the emulsion changing hose forwardly and this movement pushes the booster forwards within the sleeve to receive the detonator and thereby position the detonator and the booster together as a coupled booster/detonator assembly.

5. Further forward movement of the pushing device deploys the booster/detonator assembly further into the hole with the trigger cord uncoiling or spooling with the forward movement, while remaining connected at one end to the connection unit of the detonation unit body and at the other end to the detonator.

6. When the booster/detonator assembly has been pushed to the required detonation position in the hole, emulsion explosive is charged into the hole via a charge-up unit that is part of the machine (or may be a separate unit), with the charge-up unit dispensing explosive such as an emulsion mixture as per standard charge up processes, encases the booster/detonator assembly in emulsion and pumps while the hose is retracted or ejected out of the hole.

7. The machine (or a separate unit) optionally attaches a tie-in lead to the pick-up connection unit or moves to the next hole for the tie-in to be performed later, for example manually or via another machine operation.

Wired tie-in examples:

1. A daisy chain of mating plugs fit into a housing that has a pre-configured connection to the detonator cord as described above 2. The machine locates each plug on the housing and inserts a plug into each housing to complete the tie-in process.

3. The (single) cord is then taken back to a common trigger box.

4. If an activation of the trigger assembly is required, this could be performed at the time of individual connection or at the end of tie-in.

5. Tie-in complete.

It is noted that in another similar method, the trigger assemblies are stored as assembled units rather than as separate components.

Method 2 Embodiment

The explosion trigger is in the form of (a) a booster containing a small explosive charge and (b) a detonator for the small explosive charge.

1. The method is essentially the same as method 1.

2. The main difference is that the detonation unit body of the trigger assembly includes a trigger device that may be a wireless receiver and/or transceiver that may be triggered by (wire, laser, WiFi, Bluetooth or other communication medium). The assembly may or may not have a power source such as but not limited to a battery to power the receiver and/or transceiver.

There may be an external detonation activation system carried by the loading machine or another machine that can activate the detonator of a trigger assembly or a plurality of the trigger assemblies as required. This activation may also be achieved via hard wire connections and activation via a manual tie in process by a daisy chain style wired system. This activation may be mechanical, electrical, magnetic or other means of activating the device by wire or wireless. One specific example is a bridge plug, another is a mechanical coupling, another is a coded microchip or similar microprocessor to activate the assembly for safety reasons. There may be a receiver and/or transceiver to enable two-way communications with the assembly.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention are illustrated by way of example, and not by way of limitation, with reference to the accompanying drawings, of which.

DETAILED DESCRIPTION OF EMBODIMENTS

Embodiments will now be described more fully hereinafter with reference to the accompanying drawings, in which various embodiments, although not the only possible embodiments, of the invention are shown. The invention may be embodied in many different forms and should not be construed as being limited to the embodiments described below.

The invention relates generally to triggering explosives in holes in underground and above-ground mines and in civil engineering applications, such as tunnels.

The invention relates particularly, although by no means exclusively, to triggering explosives in holes in underground mines, such as:

(a) in the development of horizontally-extending tunnels in underground mines for the purpose of blasting rock and extending the tunnels, or (b) for mine production purposes that require explosives and detonators to be placed in a combination of angled, horizontal or vertical for the purpose of blasting rock (e.g. stoping/block caves development/infrastructure development etc.

The following description is in the context of underground mines.

Figure 1:
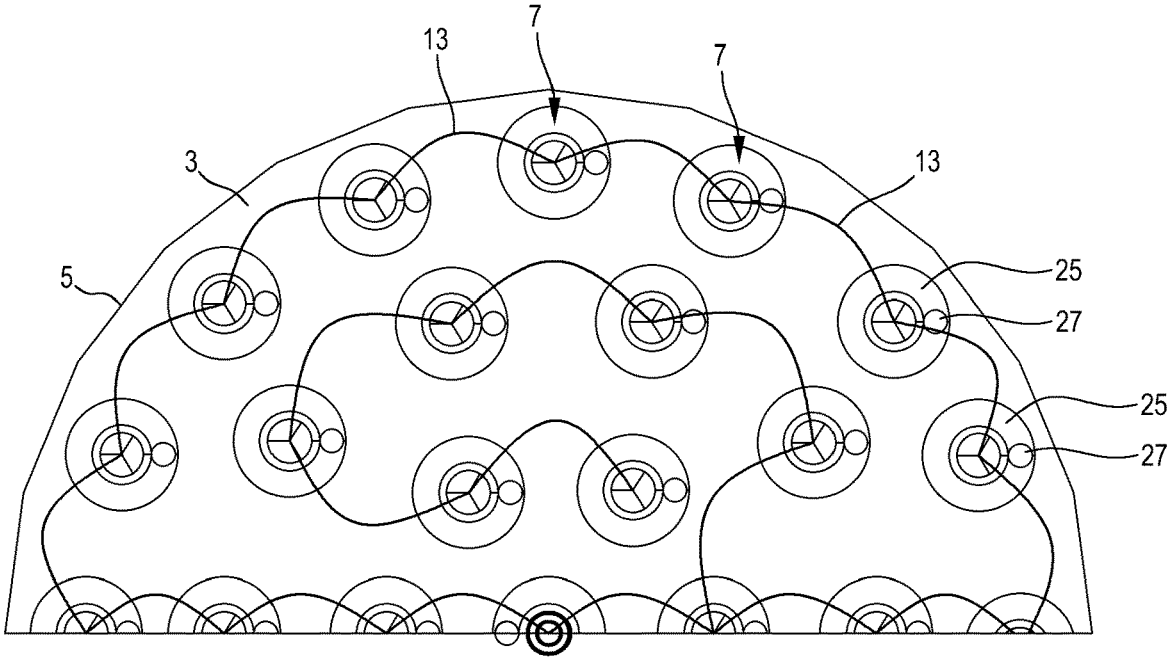
FIG. 1 is a front view of an upper half of an end face (mine face) of a tunnel in an underground mine with a plurality of trigger assemblies in accordance with an embodiment of the invention in drilled holes in the end face and a plurality of hard-wired connections in a daisy chain arrangement between detonators of the trigger assemblies and an external activation system (not shown)

FIG. 1 is a front view of an upper half of an exposed end face (mine face) 3 of a tunnel 5 in an underground mine with a plurality of trigger assemblies generally identified by the numeral 7 in accordance with an embodiment of the invention in drilled holes 9 (see FIGS. 3, 4, and 13) extending into rock 11 (see FIGS. 3, 4, and 13) in the end face 3 and a plurality of hard-wired connections 13 in a daisy chain arrangement between detonators 15 (see FIGS. 3-15) of the trigger assemblies 7. The hard-wired connections 13 are connected to an external activation system (not shown), in accordance with standard practice.

Figure 2:
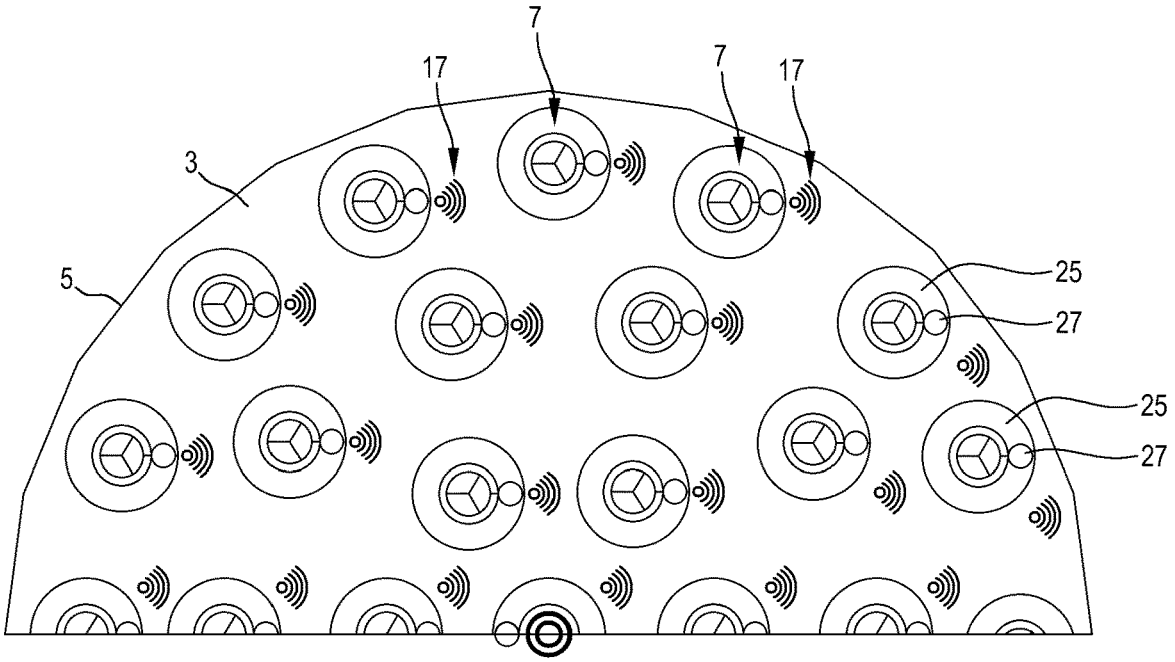
FIG. 2 is a front view of an upper half of an end face of a tunnel in an underground mine with a plurality of trigger assemblies in accordance with another, although not the only other, embodiment the invention in an operative position in drilled holes in the end face with a plurality of wireless connections between detonators of the trigger assemblies and/or an external activation system (not shown)

FIG. 2 is a front view of an upper half of an end face 3 of a tunnel 5 in an underground mine with a plurality of trigger assemblies generally identified by the numeral 7 in accordance with another, although not the only other, embodiment of the invention in drilled holes 9 (see FIGS. 3, 4, and 13) extending into rock 11 (see FIGS. 3, 4, and 13) in the end face 3. With this embodiment, there is a plurality of wireless connections indicated diagrammatically by the numeral 17 between detonators 15 (see FIGS. 3-15) of the trigger assemblies 7. The hard-wired connections 13 are connected to and an external activation system (not shown), in accordance with standard practice.

With reference to FIGS. 3 to 15, each trigger assembly 7 of this embodiment of the invention includes (a) a detonation unit body generally identified by the numeral 21, (b) an explosion trigger in the form of a booster 19 and a detonator 15, and (c) a trigger cord 31 that is connected to the detonation unit body 21 and to the explosion trigger 19, 15.

Each trigger assembly 7 can be located at or proximate an open end of the hole 9 in an initial position of the trigger assembly in the hole 9, with the detonation unit 21 body housing and supporting the booster 19, the detonator 15, and the trigger cord 31 in this embodiment of the invention.

Figure 3:
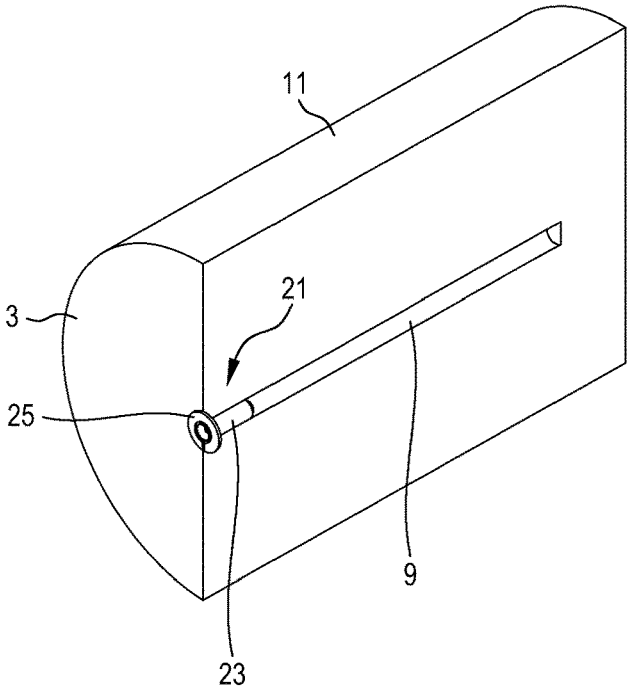
FIG. 3 is a sectional view of the embodiment of the trigger assembly shown in FIG. 1 extending into one of the holes in the end face of the tunnel shown in FIG. 1 in an initial position of the detonation assembly in the hole.
Figure 4:
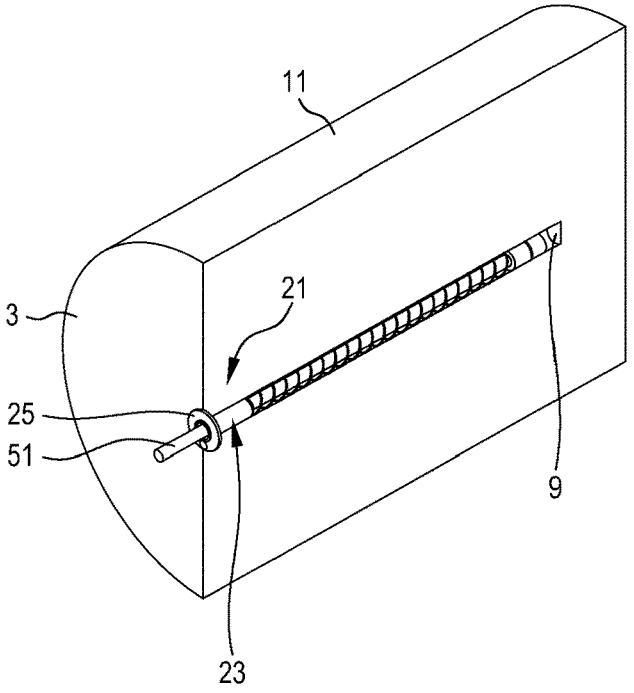
FIG. 4 is a sectional view of the embodiment of the trigger assembly shown in FIG. 1 extending into one of the holes in the end face of the tunnel shown in FIG. 1 in a detonation position of the trigger assembly in the hole, with a hose for charging an emulsion explosive extending into the hole.
Figure 5:
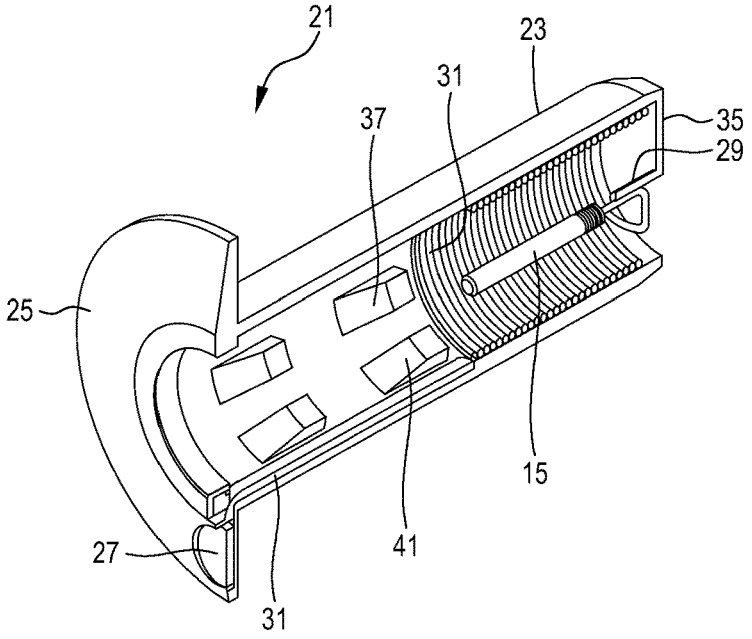
FIG. 5 is a sectional view of the trigger assembly embodiment shown in FIG. 1 which shows a detonation unit body, a trigger cord, and a detonator of the trigger assembly without a booster of the trigger assembly.
Figure 6:
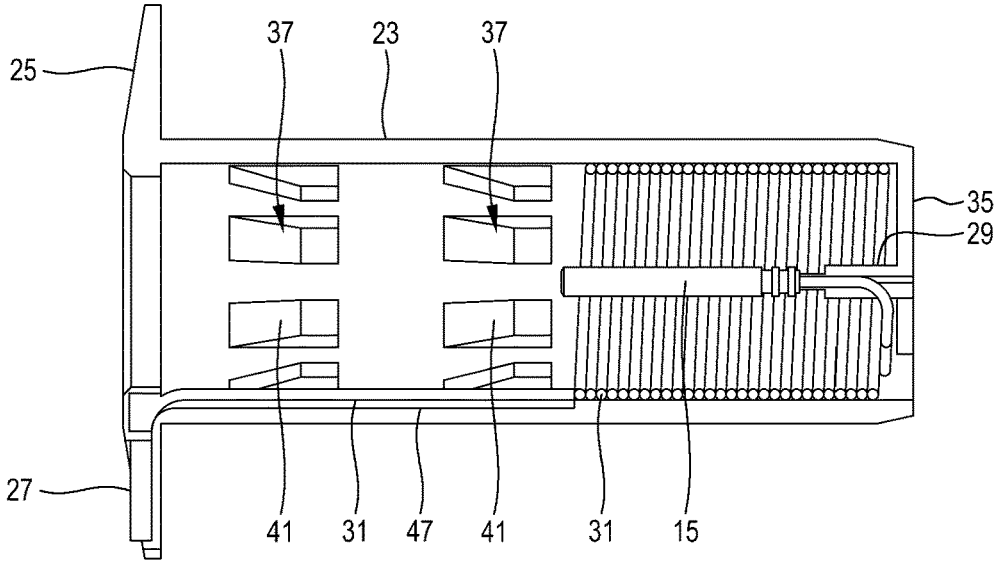
FIG. 6 is a side view of the trigger assembly embodiment shown in FIG. 5 which shows the detonation unit body, the trigger cord, and the detonator of the trigger assembly without the booster of the trigger assembly.
Figure 7:
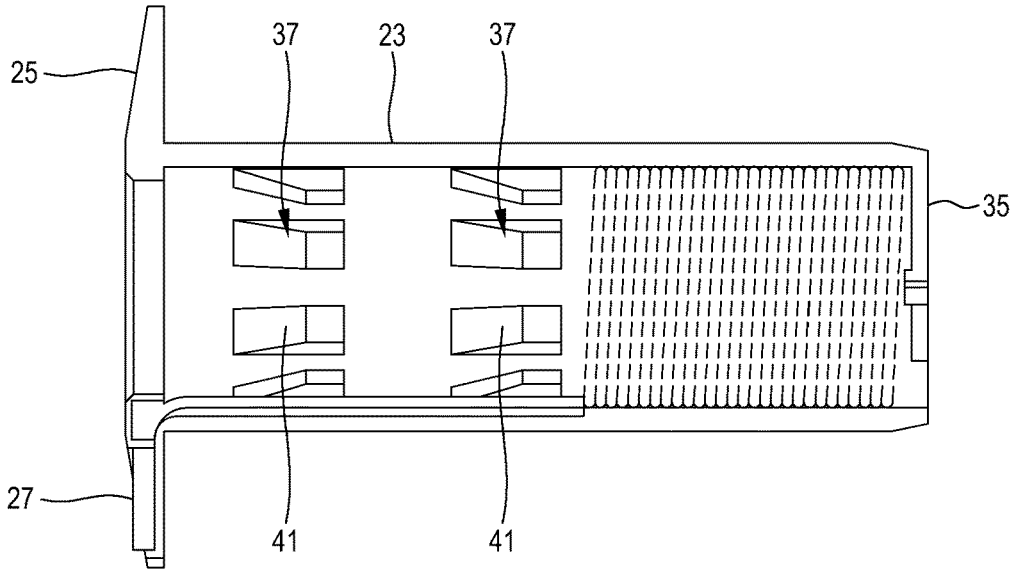
FIG. 7 is a side view of the trigger assembly embodiment shown in FIGS. 5 and 6 which shows the detonation unit body of the trigger assembly without the booster, the detonator, and the trigger cord of the trigger assembly.
Figure 8:
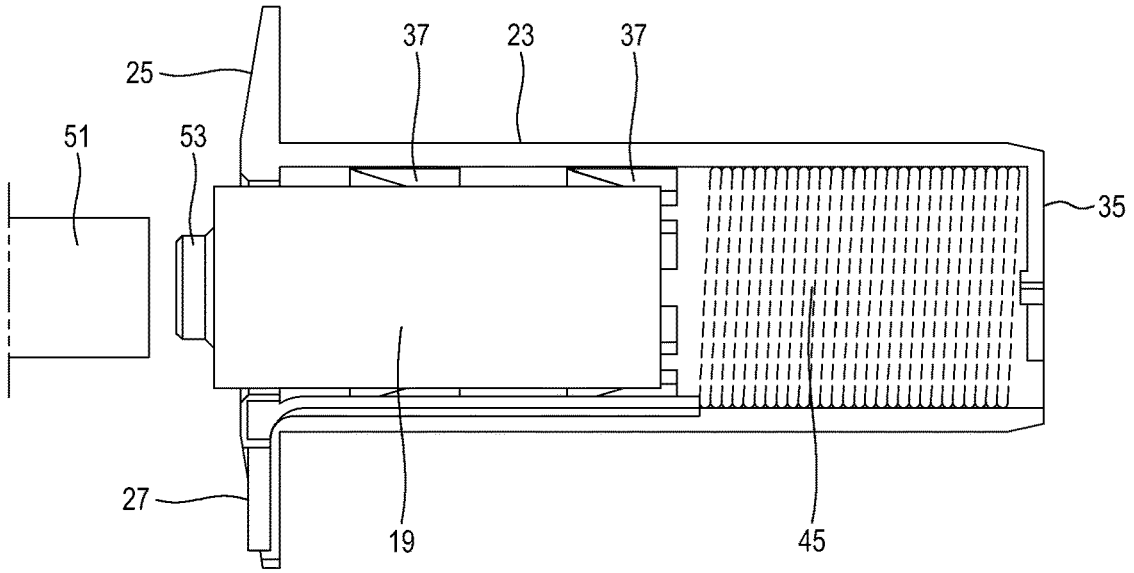
FIG. 8 is another side view that is similar to FIG. 6 which shows the detonation unit body and the booster of the trigger assembly but without the detonator and the trigger cord of the trigger assembly, and with the pusher device such as an emulsion explosive charging hose ready to be inserted into the trigger assembly.
Figure 9:
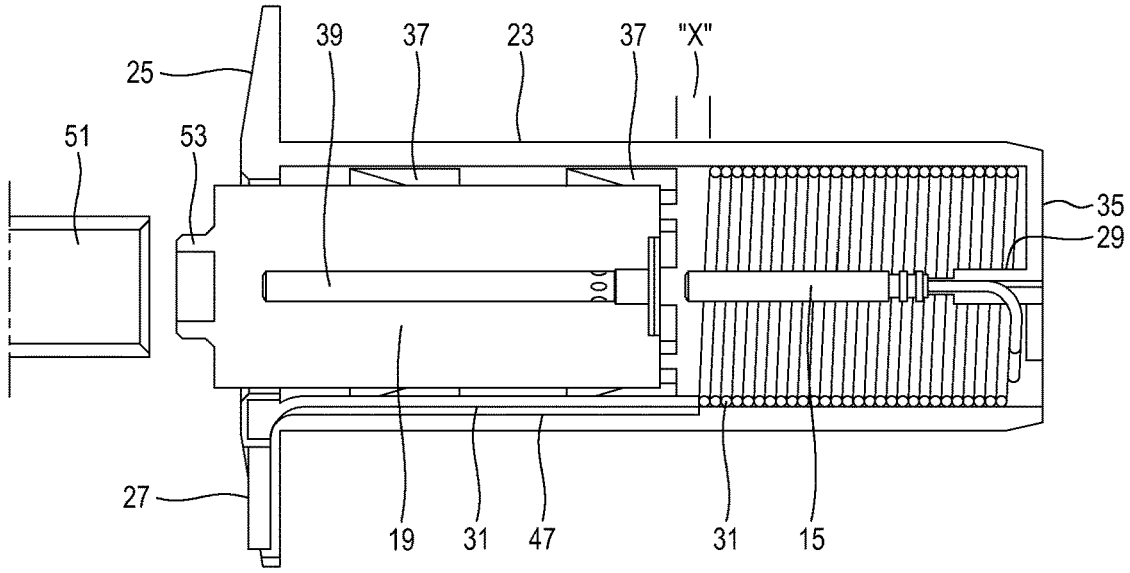
FIG. 9 is another side view that is similar to FIGS. 6 to 8 which shows the trigger assembly with the detonation unit body, the booster and the detonator, and the trigger cord of the trigger assembly, with the booster and the detonator axially spaced apart and housed within the detonation unit body, and with the pushing device such as an emulsion explosive charging hose ready to be inserted into the trigger assembly.
Figure 10:
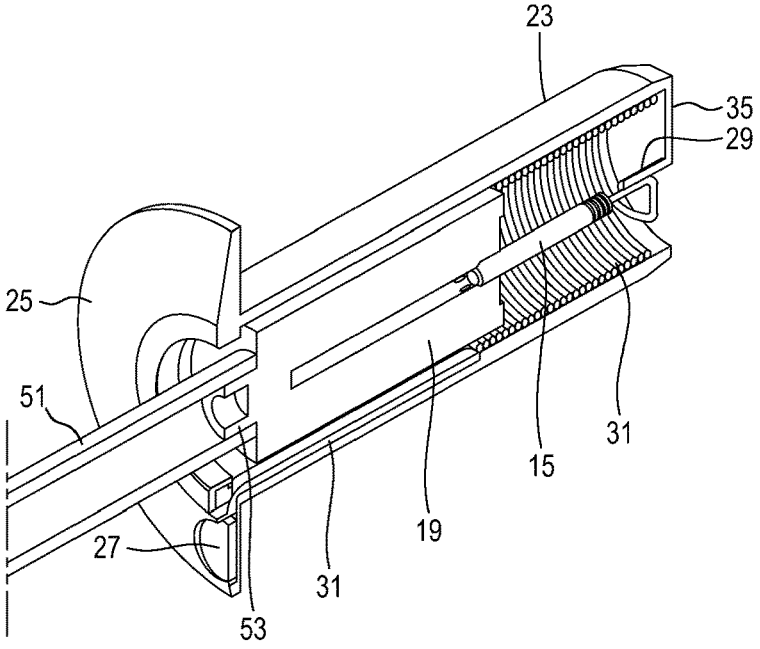
FIG. 10 is a sectional view of the trigger assembly embodiment shown in FIG. 9 with the pushing device such as the emulsion explosive charging hose partially inserted into a sleeve of the detonation unit body, with the hose moving the booster forwardly so that the detonator is partially housed within the booster.
Figure 13:
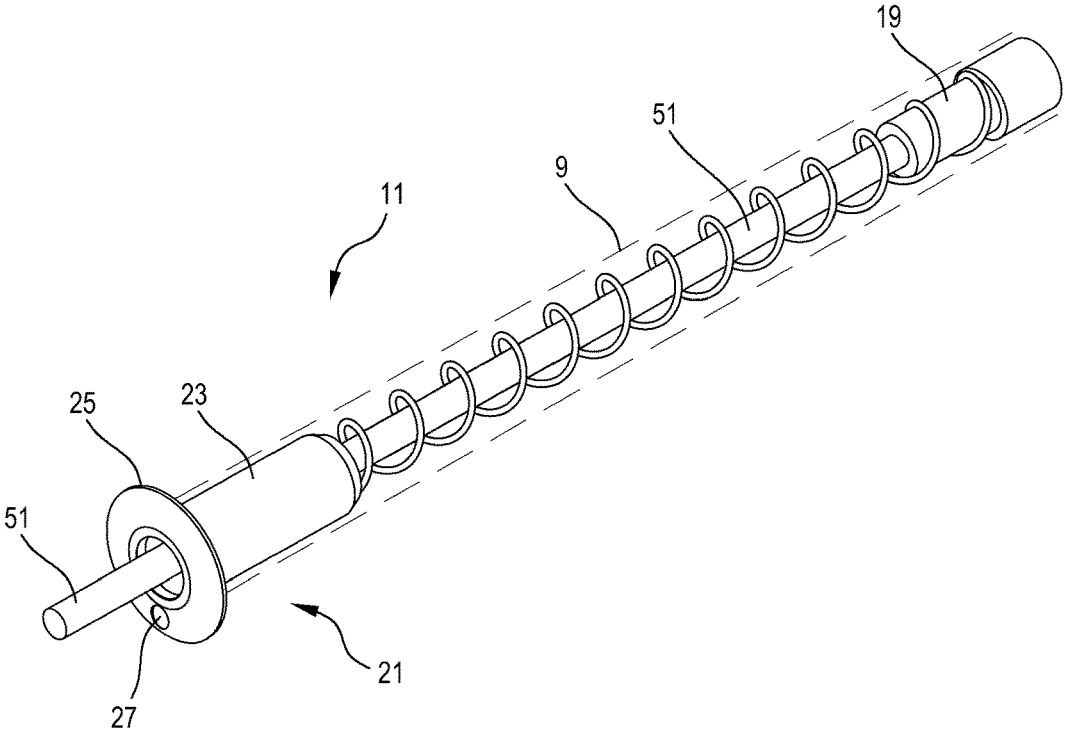
FIG. 13 is an isometric view of the trigger assembly embodiment shown in FIGS. 5 to 12 with the detonator housed in the booster and moved forward to the detonation position in the hole (with the hole shown by dotted lines) and spaced away from the detonation unit body, with the assembly of the booster and the detonator moved into this position by forward movement of the pushing device such as an emulsion explosive charging hose in the hole.
Figure 14:
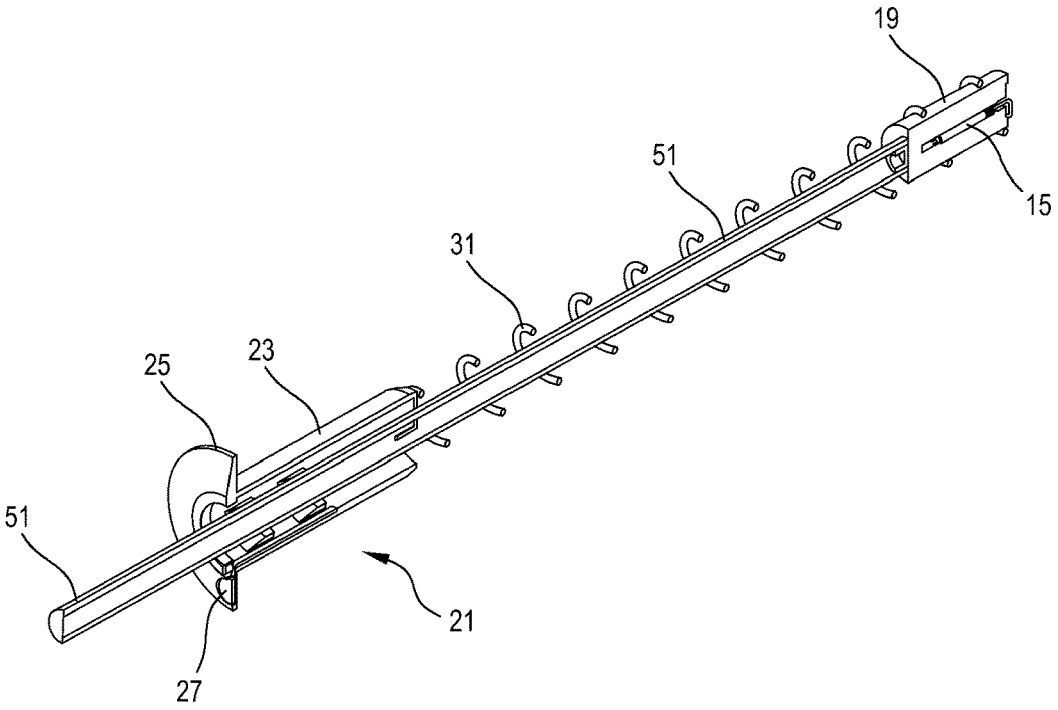
FIG. 14 is a sectional view of the trigger assembly embodiment shown in FIG. 13 in the detonation position in the hole.
Figure 15:
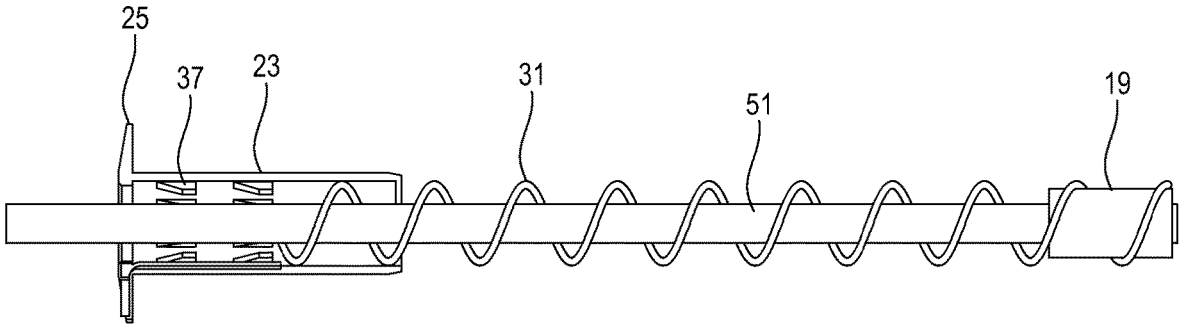
FIG. 15 is a side view of the trigger assembly embodiment shown in FIGS. 13 and 14 in the detonation position in the hole, with the Figure showing the detonator unit as a sectional view.
Figure 16:
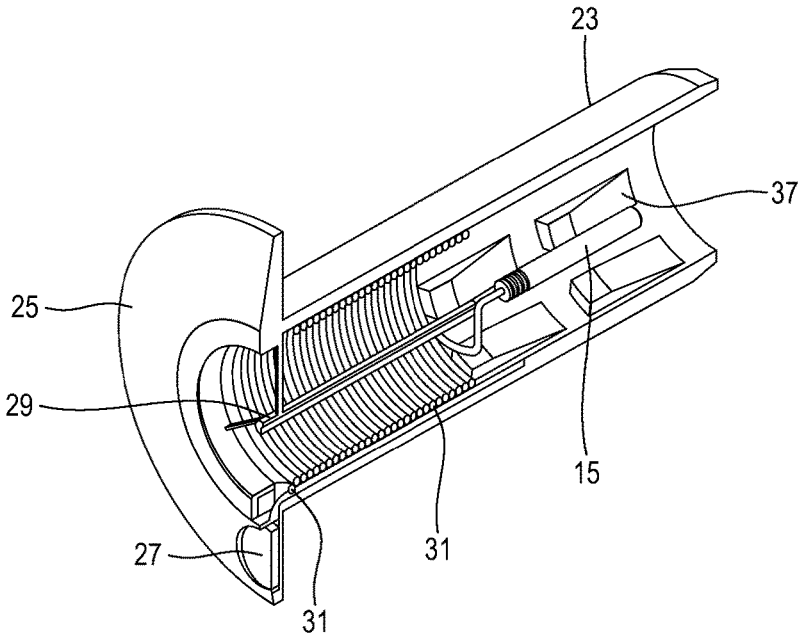
FIG. 16 is a partially cut away perspective view of another embodiment of the trigger assembly, without the booster of the trigger assembly.
Figure 17:
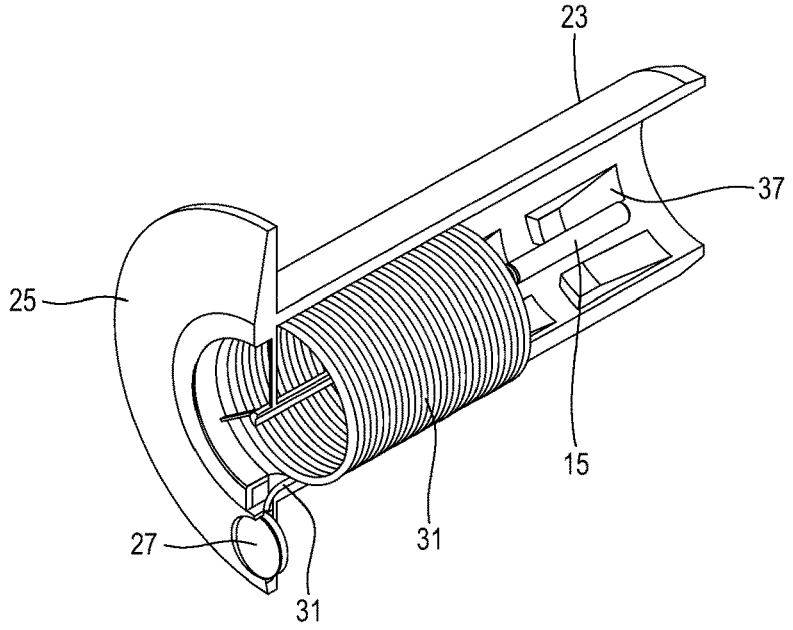
FIG. 17 is a perspective view of the embodiment of the trigger assembly shown in FIG. 16, without the booster of the trigger assembly.
Figure 18:
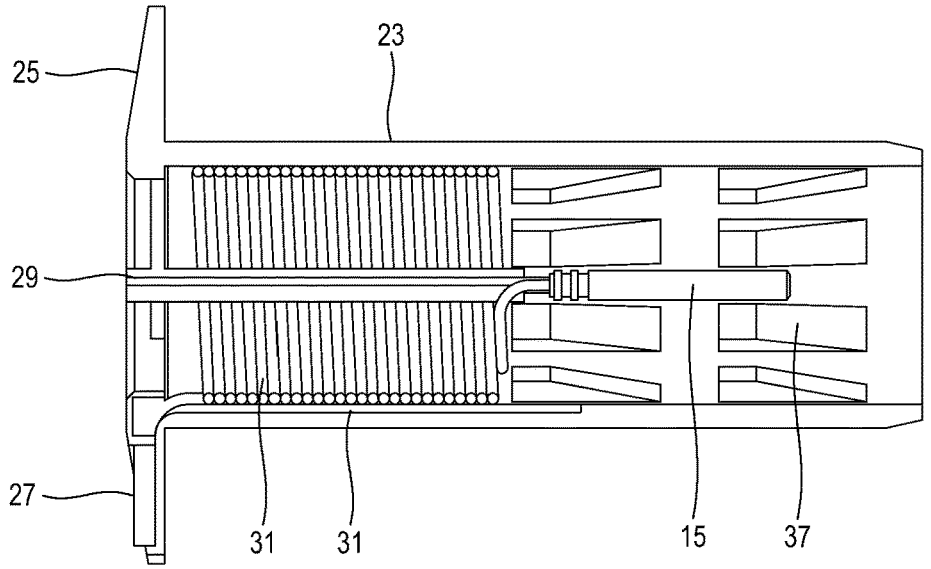
FIG. 18 is a side view of the embodiment of the trigger assembly shown in FIG. 16, without the booster of the trigger assembly.
Figure 19:
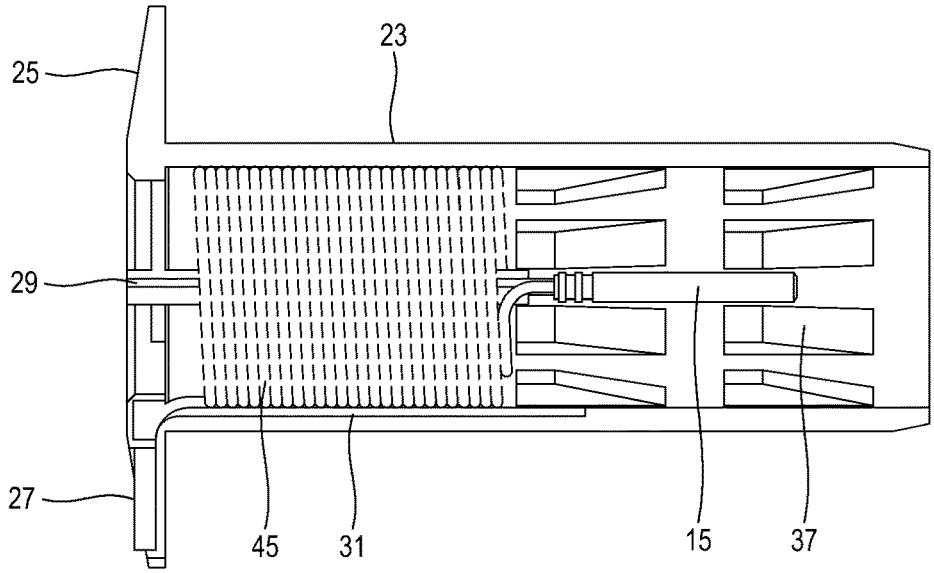
FIG. 19 is a side view of the embodiment of the trigger assembly shown in FIG. 16, without the booster and the trigger cord of the trigger assembly.

In addition, each trigger assembly 7 is configured to be separated from an assembled form when the explosion trigger 19, 15 comprising the booster 19 and the detonator 15 is moved from an initial position in the hole 9 shown in FIG. 3 to a detonation position in the hole 9 shown in FIGS. 13 to 15, with the detonator unit body 21 remaining at or proximate the open end of the hole 9 and the booster 19 and the detonator 15 being located further into the hole 9 at a required position for detonating explosives in the hole 9 in the detonation position.

In both embodiments shown in FIGS. 1 and 2, an explosives delivery vehicle (not shown—which may be operator driven or remotely controlled) separately stores (a) a plurality of the boosters 19 and (b) a plurality of assemblies of the detonation unit body 21 and the detonator 15 housed in the detonation unit body 21 and is operable to bring these separately-stored components together to form a plurality of trigger assemblies 7 and position each trigger assembly 7 in turn in a hole 9 in the initial position of the hole 9 and, via an emulsion explosive changing hose 51, to facilitate movement of the explosion trigger 19, 15 to the detonation position in the hole 9, as described further below.

The detonation unit body 21 includes:

(a) a cylindrical sleeve 23 (noting that the invention is not confined to sleeves and is not confined to cylindrical-shaped sleeves) that is configured to extend into the hole 9 and to receive and support the booster 19 and the detonator 15 within the compartment defined by the sleeve 23 in the initial position of the trigger assembly 7 in the hole 9;

(b) a retaining means in the form of a collar 25 at one end of the sleeve 23 (a rearward end in the direction of insertion of the trigger assembly into the hole 9) that is configured to be located against the end face 3 of the rock mass 11 in which the hole 9 is formed, with the sleeve 23 extending into the hole 9 and the booster 19 and the detonator 15 housed within and protected by the sleeve 23 in the hole 9 when the trigger assembly 7 is in the initial position in the hole 9, and the collar 25 including a connection unit 27 for an external detonation activation system (not shown); and (c) a mount 29 at a forward end of the sleeve 23 (in the direction of insertion of the assembly into the hole 9) that receives and supports the detonator 15 within the sleeve 23 when the trigger assembly 7 is in the initial position in the hole 9.

It is noted that other embodiments of the invention include alternative retaining means to the collar 25. For example, there are embodiments that include a biasing means that is operable after the trigger assembly has been positioned in the initial position in a hole to apply outward force against the side wall of the hole 9 and thereby prevent forward movement of the detonation unit body 21 in the hole 9 from the initial position in the hole 9.

The trigger cord 31 is connected at one end to the detonator 15 and at the other end to the connection unit 27 of the collar 25, and the length of the trigger cord 31 is selected to be at least the length required to span the distance between the detonator 15 and the connection unit 27 when the detonator 15 and the booster 19 are in the detonation position of the trigger assembly 7 in the hole 9—see FIGS. 13-15. As noted above, this connection of the trigger cord 31 to the detonator 15 and the connection unit 27 is an important feature of the invention because the trigger cord can be conveniently tied-in to an external detonation activation system (for example, connected via wireless or by hard wired connections) for the plurality of holes.

An internal wall of the sleeve 23 includes a spiral-shaped channel 45 (see FIGS. 7 and 8) which locates the trigger cord 31 in a spiral arrangement as shown in FIGS. 5, 6, and 9-12 when the trigger assembly 7 is in the initial position in the hole 9.

The internal wall of the sleeve 23 also includes an axially-extending channel 47 that receives a length of the trigger cord 31 that connects the remaining length of the trigger cord 31 to the connection unit 27.

It is noted that there are embodiments of the invention in which the trigger cord 31 is positioned around the sleeve 23.

The detonation unit body 21 also includes a frangible wall 35 at a forward end of the sleeve 23 in the direction of insertion of the trigger assembly 7 into the hole 9 that closes the forward end of the sleeve 23 and prevents forward movement of the explosion trigger into the hole 9 and is configured to be detached from the sleeve 23 when a force in excess of a threshold force is applied to the wall 35. With this arrangement, when the explosion trigger comprising the booster 19 and the detonator 15 is housed in the sleeve 23 in the initial position of the trigger assembly 7 in the hole 9, the wall 35 is a barrier to movement of the explosion trigger from within the sleeve 23 via the forward end of the sleeve 23.

In the embodiment shown in FIGS. 1-15, the detonator 15 is positioned ahead of the booster 19 within the sleeve 23 in the direction of insertion of the trigger assembly 7 into the hole 9.

As is described further below, in the embodiment shown in FIGS. 16-27 the positions of the detonator 15 and the booster 19 are reversed.

The detonation unit body 21 includes formations in the form of projections 37 on an internal wall of the sleeve 23 that hold and guide the booster 19 within the sleeve 23 so that there is an axial gap "X" (see FIG. 9) between the booster 19 and the detonator 15 in the initial position of the trigger assembly 7 in the hole 9. The arrangement of the projections 37 and the booster 19 is such that there is a friction-fit between the projections 37 and the booster 19 that holds the booster 19 in the position shown in FIG. 9, i.e. spaced axially from the detonator 15 in the initial position of the trigger assembly 7 in the hole 9. In this regard, the projections 37 are formed with tapered inner walls 41 that facilitate guiding movement of the booster 19 forwardly within the sleeve 23.

The detonator 15 is an elongate element.

The detonator mount 29 of the detonation unit 15 is positioned at the forward end of the sleeve 23 and supports the detonator 15 to extend rearwardly into the sleeve 23 towards the collar end of the sleeve 23, with the booster 19 positioned closer to the collar end of the sleeve 23 in the initial position of the trigger assembly 7 in the hole 9.

With this arrangement, the booster 19 includes an elongate chamber 39 that is open at one end for receiving the elongate detonator 15, with the detonator 15 and the booster 19 being configured so that the detonator 15 and the elongate chamber 39 are aligned axially and spaced apart axially in the initial position of the trigger assembly 7 in the hole 9.

The detonator 15 and the booster 19 are configured so that the detonator 15 can be received and housed in the elongate chamber 39 when the booster 19 is moved forwardly in the direction of insertion of the trigger assembly 7 into the hole 9 towards the detonator 15.

Figure 11:
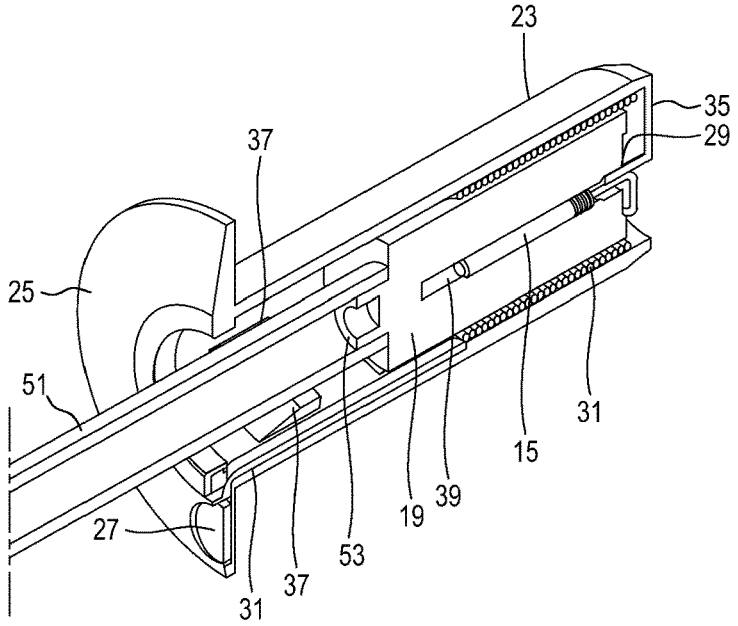
FIG. 11 is a sectional view of the trigger assembly embodiment shown in FIG. 10 with the pushing device such as an emulsion explosive charging hose further inserted into the sleeve of the detonation unit body so that the detonator is fully housed in the booster.
Figure 12:
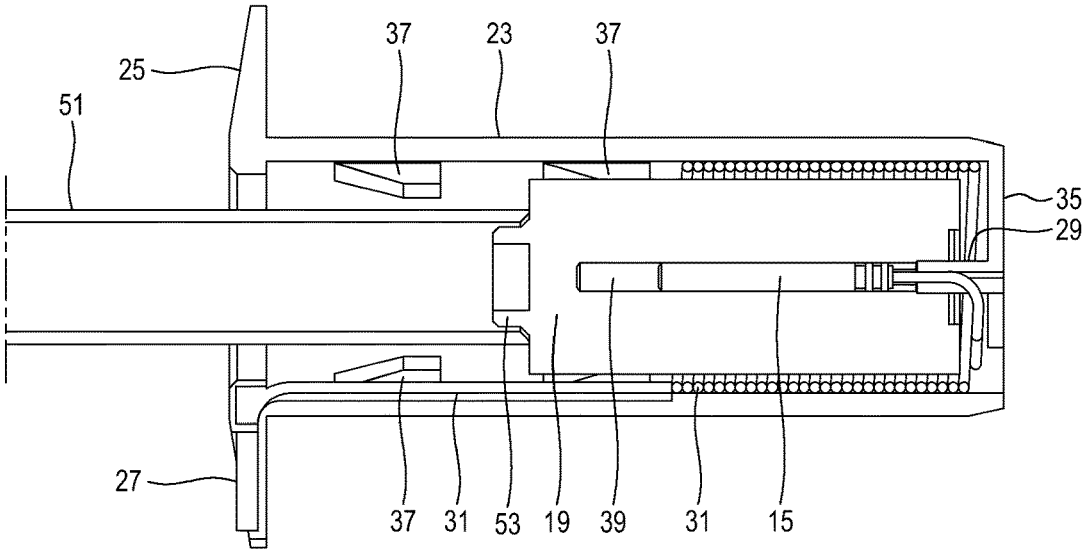
FIG. 12 is a side view of the trigger assembly in the position shown in FIG. 11.

This movement of the booster 19 within the sleeve 23 is illustrated in FIGS. 9-12, with FIGS. 11 and 12 showing the end point of the movement within the sleeve 23. At this end point, the detonator 15 is completely housed in the booster 19 and forms a booster/detonator assembly.

Further forward movement of the booster/detonator assembly within the sleeve 23 requires breaking the frangible wall 35. The further forward movement transports the booster/detonator assembly from the detonation unit body 21 to the detonation position of the trigger assembly in the hole 9. This position is shown in FIGS. 13-15.

The trigger assembly can be moved forwardly from the initial position of the trigger assembly 7 in the hole 9 to the detonation position of the trigger assembly 7 in the hole 9 for example via force applied as a consequence of forward movement of the emulsion explosive changing hose 51—see FIGS. 9-12.

In this regard, the rearward end of the booster 19 (in the direction of movement of the trigger assembly into the hole 9) includes a sleeve 53 that can receive and locate a forward end of the hose 51 on the booster 19.

The external detonation system may be any suitable system.

By way of example, the trigger assembly 7 may include a control system that includes an activation sequence for activating the detonator 15 that can be initiated via a loading machine or another machine either during loading each hole 9, at the end of loading each hole 9, or after all holes 9 are loaded.

Activation may also be achieved during a manual tie-in process, for example if performed by a daisy chain style wired system. This activation may be mechanical, electrical, magnetic or other means of activating the device. One specific example is a bridge plug, another is a mechanical coupling, and another is a coded chip to activate the detonator.

One example of a method of inserting the trigger assembly 7 shown in FIGS. 1-15 into the hole 9 is described below.

Method 1 Embodiment

1. A purpose-built machine (not shown) separately stores (a) a plurality of the boosters 19 and (b) a plurality of the assemblies of the detonation unit body 21 and the detonator 15 housed in the detonation unit body 21, with the trigger cord 31 interconnecting the detonation unit body 21 and the detonator 15 in each assembly.

2. When the trigger assembly 7 shown in FIGS. 1-15 is required for a hole 9, and the machine is positioned in an aligned position to insert a trigger assembly 7 into the hole, the machine removes (a) a booster 19 and (b) an assembly of the detonation unit body 21 and the detonator 15 from the separate storage locations and positions the booster 19 into the sleeve 23 of the detonation unit body 21 in the position shown in FIG. 9, with an axial gap "X" between the booster 19 and the detonator 15, thereby forming the trigger assembly 7.

3. The machine then deploys the trigger assembly 7 into to the initial position of the trigger assembly in the hole 9, with the collar 25 of the detonation unit 21 contacting the exposed face 3 of the rock 11, thereby locating the trigger assembly 7 in the initial position of the assembly in the hole 9. As is described below in relation to FIGS. 33-36, typically, the machine includes an insertion device to support the trigger assembly 7 in a loading position and to move the trigger assembly forward to locate the trigger assembly 7 in the initial position in the hole 9.

4. The machine drives the emulsion changing hose 51 forwardly and this movement pushes the booster 19 forwards within the sleeve 23 to receive the detonator 15 and thereby position the explosion trigger comprising the detonator 15 and the booster 19 together as a coupled booster/detonator assembly as shown in FIGS. 11 and 12.

5. Further forward movement of the emulsion changing hose 51 deploys the booster/detonator assembly further into the hole 9 with the trigger cord 31 uncoiling or spooling with the forward movement, while remaining connected at one end to the connection unit 27 of the detonation unit body 21 and at the other end to the detonator 15.

6. When the booster/detonator assembly has been pushed to the detonation position in the hole 9 as shown in FIGS. 13-15, emulsion explosive is charged into the hole 9 via a charge-up unit that is part of the machine (or may be a separate unit), with the charge-up unit dispensing emulsion as per standard charge up processes, encases the booster/detonator assembly in emulsion and pumps while the hose 9 is retracted or ejected out of the hole 9.

7. The machine optionally attaches a tie-in lead to the pick-up connection unit 27 or moves to the next hole 9 for the tie-in to be performed later, for example manually or via another machine operation.

Wired tie-in example:

1. A daisy chain of mating plugs fit into a housing that has a pre-configured connection to the trigger cord 31 as described above 2. The machine locates each plug on the housing and inserts a plug into each housing to complete the tie-in process.

3. The (single) cord is then taken back to a common trigger box.

4. If an activation of the trigger assembly is required, this could be performed at the time of individual connection or at the end of tie-in.

5. Tie-in complete.

FIGS. 33-36 illustrate an embodiment of the above-mentioned insertion device to support another embodiment of the trigger assembly 7 to that shown in other Figures in a loading position in the above-described machine and to move the trigger assembly 7 forward to locate the trigger assembly 7 in the initial position in the hole 9.

With reference to FIGS. 33-36, the insertion device is indicated by the numeral 63 and includes a tube 69 that has a forward end that is configured to receive and support the rearward end of the trigger assembly 7.

The trigger assembly 7 has the same components of a detonation unit body 21, explosion trigger (booster 19 and detonator 15 in this instance), and trigger cord 31 as other embodiments shown in the Figures.

There are differences, with one difference being that the trigger cord 31 is wound around the sleeve 23 of the detonation unit body 21, rather than being positioned internally.

Another difference is that a forward end of the explosion trigger has an arrow-head formation 65 that facilitates insertion of the trigger assembly 7 into a hole 9.

The insertion tube 69 is supported by an outer sleeve 67 for movement between a retracted loading position and an extended loaded position in which the trigger assembly 7 is in the initial position in the hole 9.

The insertion tube 69 is also formed to receive therethrough an emulsion charging hose (not shown). The emulsion charging hose also forms part of the insertion device 63.

When the trigger assembly 7 is in the initial position in the hole 9, the machine pushes the emulsion explosives hose through the insertion tube 69 so that the hose contacts the detonator and moves the detonator to a forward, operative position in the hole, with the detonator unit body 21 remaining in the initial position in the hole 9. The insertion tube 69 remains in contact with the detonator unit body 21 during this movement of the emulsion explosives hose and during subsequent withdrawal of the hose, and the contact assists in retaining the detonator unit body 21 in position.

It is noted that the invention extends to embodiments in which the contact force of the insertion tube 69 on the detonator unit body 21 is not required.

It is also noted that in other embodiments, the trigger assemblies are stored as assembled units in the machine rather than as separate components.

In other embodiments, the trigger assemblies are stored separately form the machine and are hand-loaded on the machine, supported by the insertion tube 69.

Another example of a method of inserting the trigger assembly 7 shown in FIGS. 1-15 into the hole 9 is described below.

Method 2 Embodiment

The method is essentially the same as method 1.

The main difference is that the detonation unit body 21 of the trigger assembly 7 includes a trigger device that may be a wireless receiver that may be triggered by (wire, laser, WiFi, Bluetooth or other communication medium). The trigger assembly 7 may or may not have a power source such as but not limited to a battery to power the receiver.

As noted above, in the embodiment of the trigger assembly shown in FIGS. 16-27 the positions of the detonator 15 and the booster 19 are reversed to that in the embodiment shown in FIGS. 1-15.

The same reference numerals are used in FIGS. 1-15 and in FIGS. 16-27 to describe the same structural features.

With reference to FIGS. 16-27, the detonator 15 is supported by the mount 29 to be directed forwardly within the sleeve 23.

Figure 20:
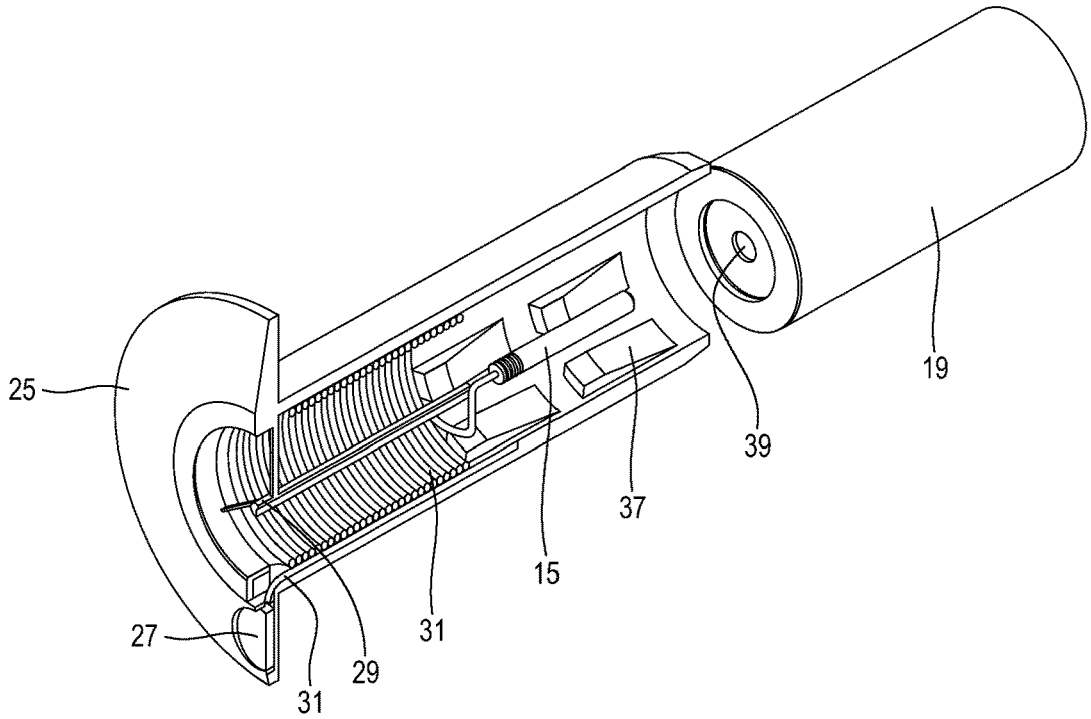
FIG. 20 is a perspective view of the embodiment of the trigger assembly shown in FIG. 16, with the booster of the trigger assembly aligned with and positioned forwardly of the trigger assembly.
Figure 21:
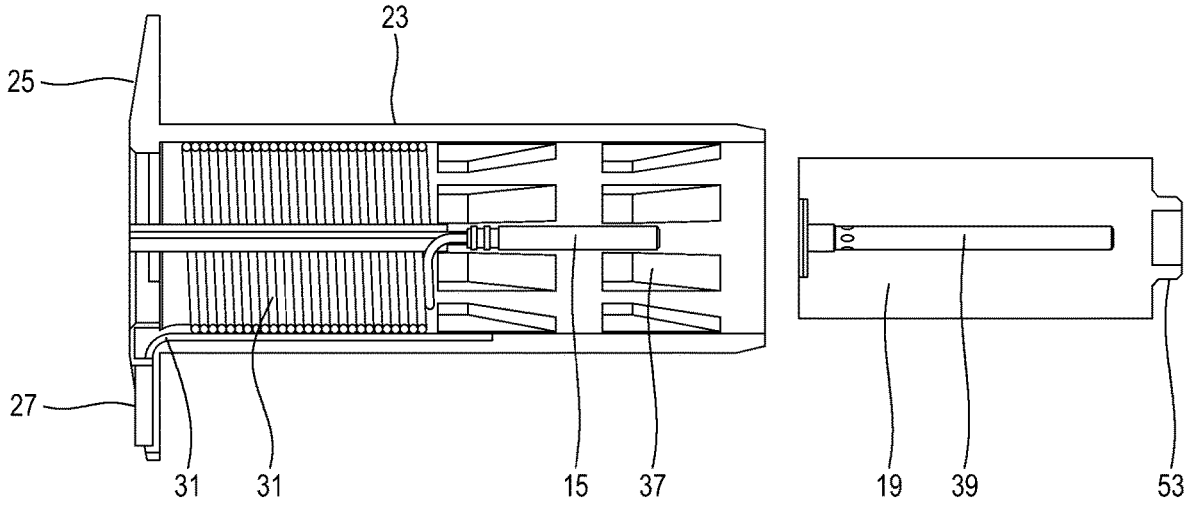
FIG. 21 is a sectional view of the embodiment of the trigger assembly shown in FIG. 20, with the booster of the trigger assembly aligned with and positioned forwardly of the trigger assembly.

As can be appreciated from FIGS. 20 and 21, the trigger assembly 7 is assembled by inserting the booster 19 into the sleeve 23 via the forward end of the sleeve 23.

Figure 22:
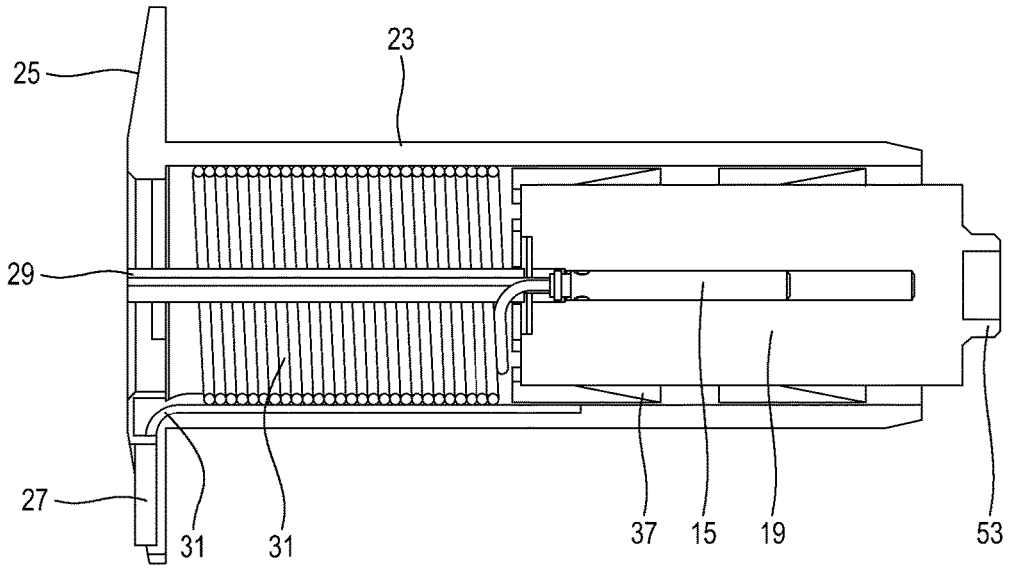
FIG. 22 is a sectional view of the embodiment of the trigger assembly shown in FIG. 20, with the booster of the trigger assembly inserted into the detonation unit body, with the booster extending onto and retained by the detonator of the trigger assembly.
Figure 23:
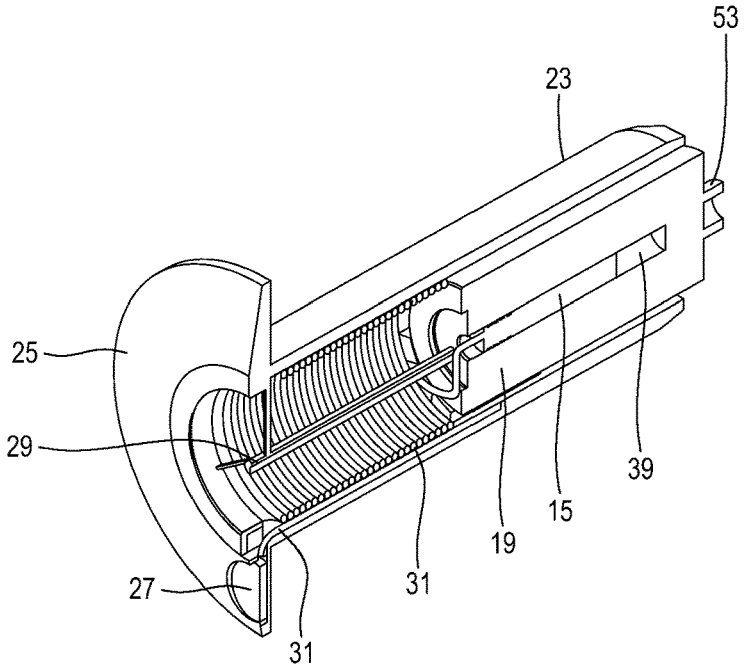
FIG. 23 is a perspective view of the embodiment of the trigger assembly shown in FIG. 22, with the booster of the trigger assembly inserted into the detonation unit body and extending onto and retained by the detonator of the trigger assembly and forming a booster/detonator assembly.
Figure 24:
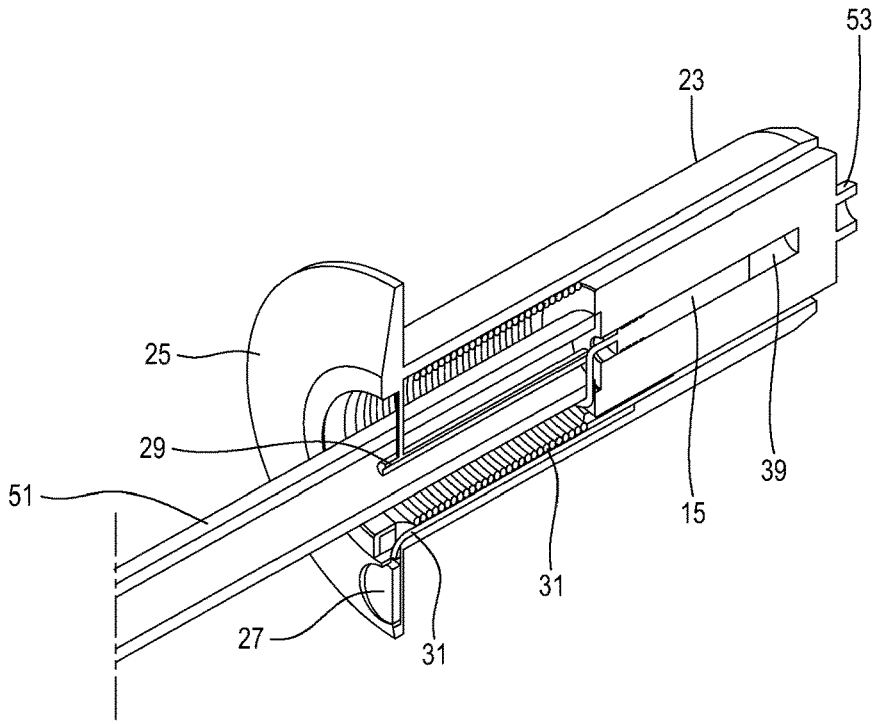
FIG. 24 is a sectional view of the embodiment of the trigger assembly shown in FIG. 23, with the booster of the trigger assembly inserted into the detonation unit body and extending onto and retained by the detonator of the trigger assembly, and with a pushing device such as an emulsion explosive charging hose extending into the detonation unit body and bearing against a rear end of the booster/detonator assembly.
Figure 25:
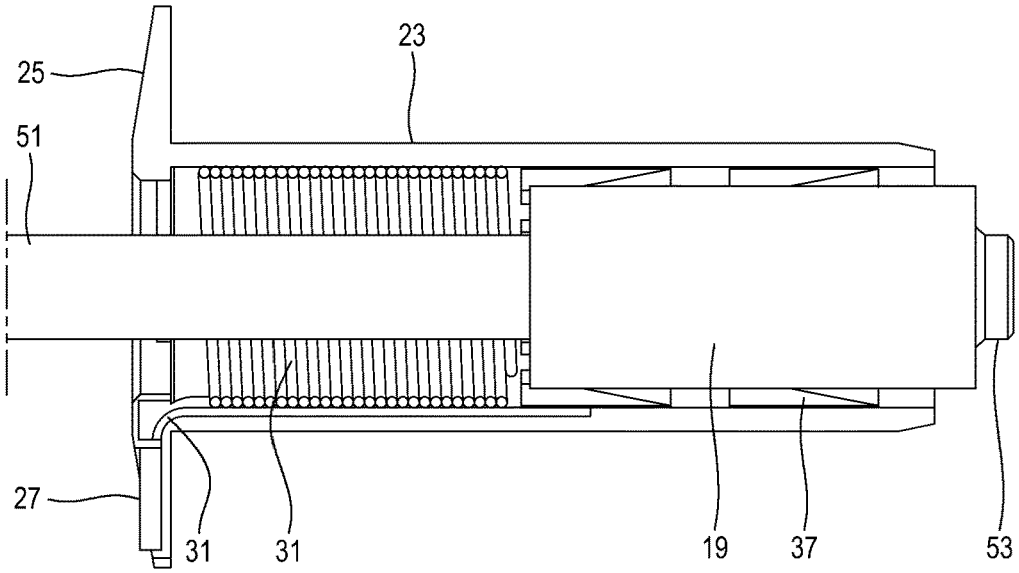
FIG. 25 is a side view of the arrangement shown in FIG. 24.
Figure 26:
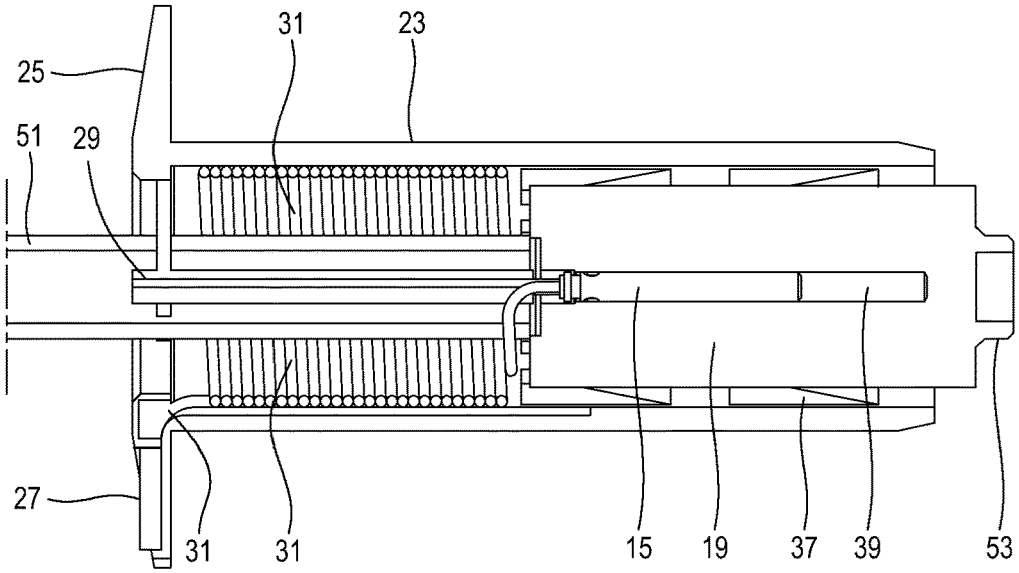
FIG. 26 is a sectional view of the arrangement shown in FIG. 24.
Figure 27:
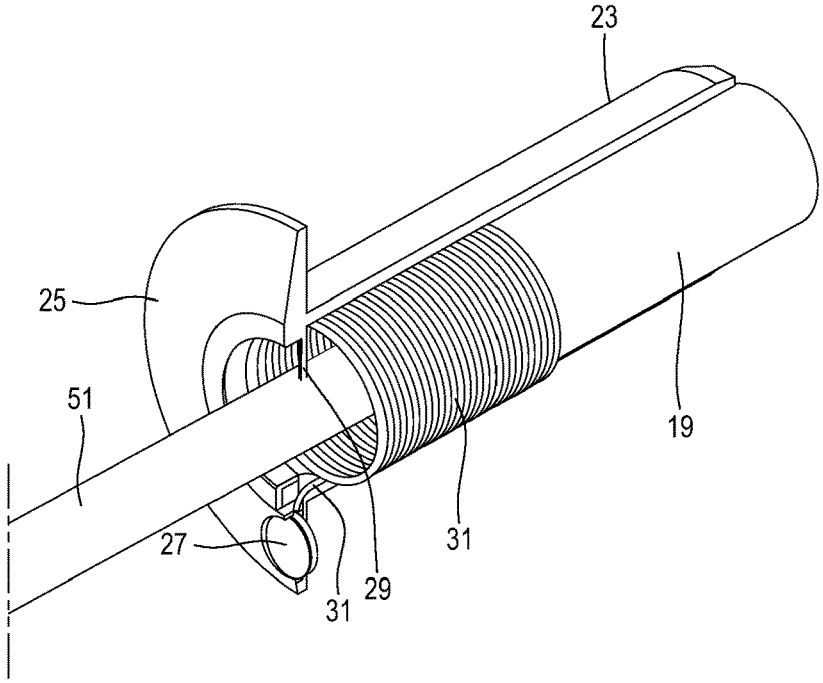
FIG. 27 is another sectional view of the arrangement shown in FIG. 24.
Figure 28:
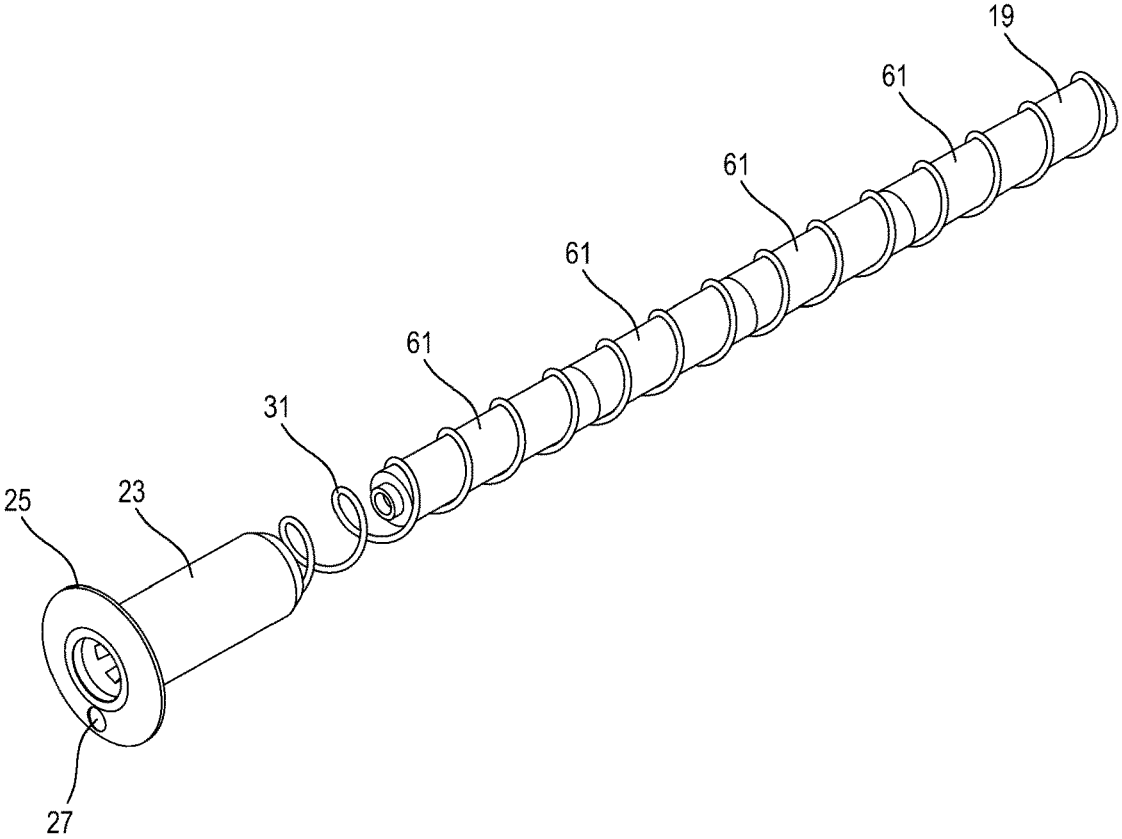
FIG. 28 is an isometric view of the embodiment of the trigger assembly shown in FIGS. 5 to 12 with the detonator housed in the booster and moved forward to the detonation position in the hole and spaced away from the detonation unit body, with the assembly of the booster and the detonator moved into this position by forward movement of a series of pre-packaged cartridges of explosive into the hole.
Figure 29:
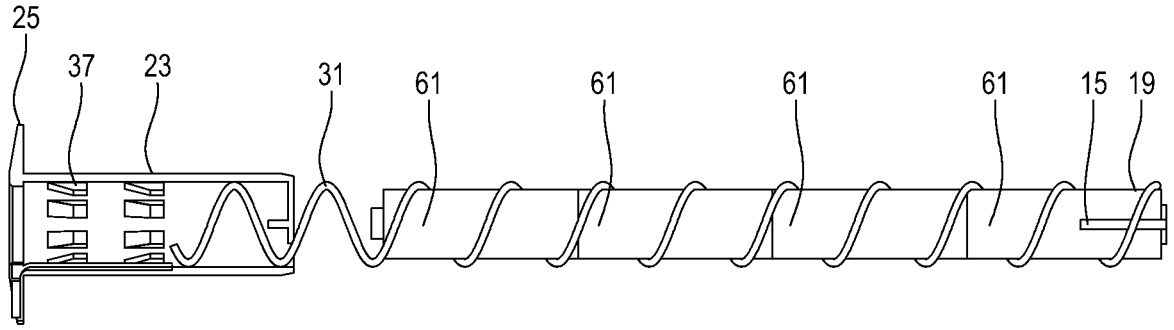
FIG. 29 is a sectional view of FIG. 28.
Figure 30:
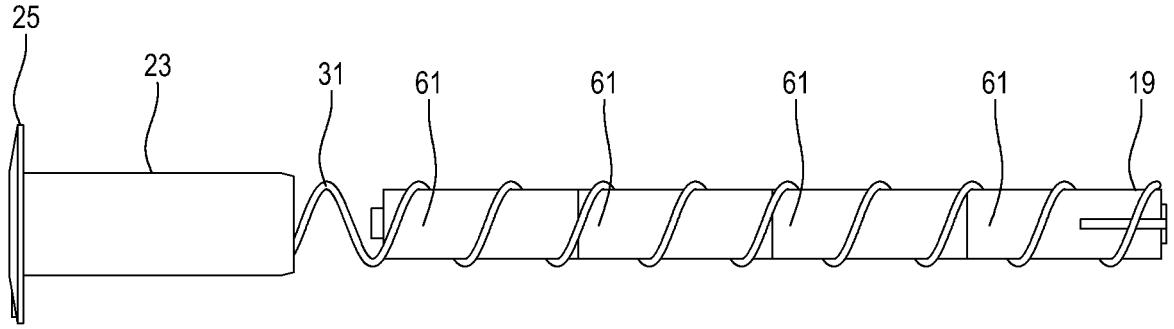
FIG. 30 is a side view of FIG. 30.
Figure 31:
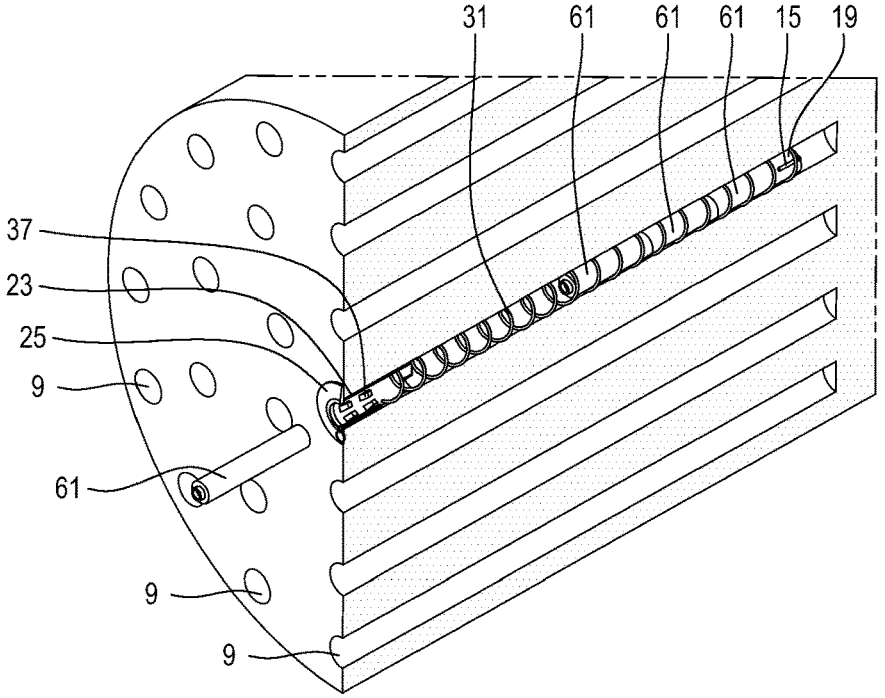
FIG. 31 shows the trigger assembly and series of pre-packaged cartridges of explosive positioned in one of a series of drilled holes in the end face of the tunnel shown in FIG. 1.

As can be seen in FIGS. 22 and 23, the detonator 15 and the elongate chamber 39 in the booster 19 are aligned and, when fully inserted in the sleeve 23, the detonator 15 is received in the chamber 39.

With reference to FIGS. 24 to 27, in use, when the trigger assembly 7 shown in FIGS. 22 and 23 is inserted into a hole 9 in the initial position of the trigger assembly 7, the explosion trigger comprising the booster 19 and the detonator 15 can be moved into the hole 9 to the detonation position by forward movement of an emulsion hose 51. It can be appreciated that this forward movement of the hose 51 initially breaks the connection of the mount 29 to the sleeve 23 so that the detonator 15, which is supported by the mount 29, can be moved forward.

FIGS. 28-32 illustrate the embodiment of the trigger assembly 7 of the invention shown in FIGS. 1-15 that is used in conjunction with a series of pre-packaged cartridges 61 of explosives that are arranged end to end to extend into a hole 9.

The same reference numerals are used in FIGS. 1-15 and in FIGS. 28-32 to describe the same structural features.

Figure 32:
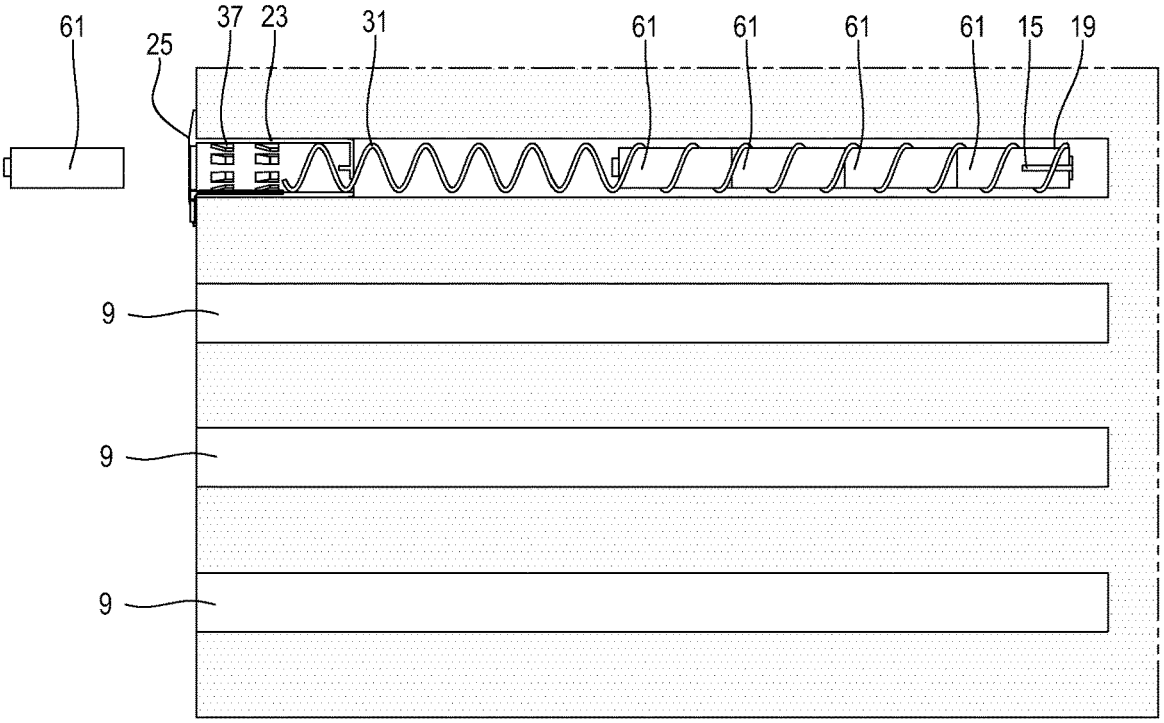
FIG. 32 is a side view of part of FIG. 31.
Figure 33:
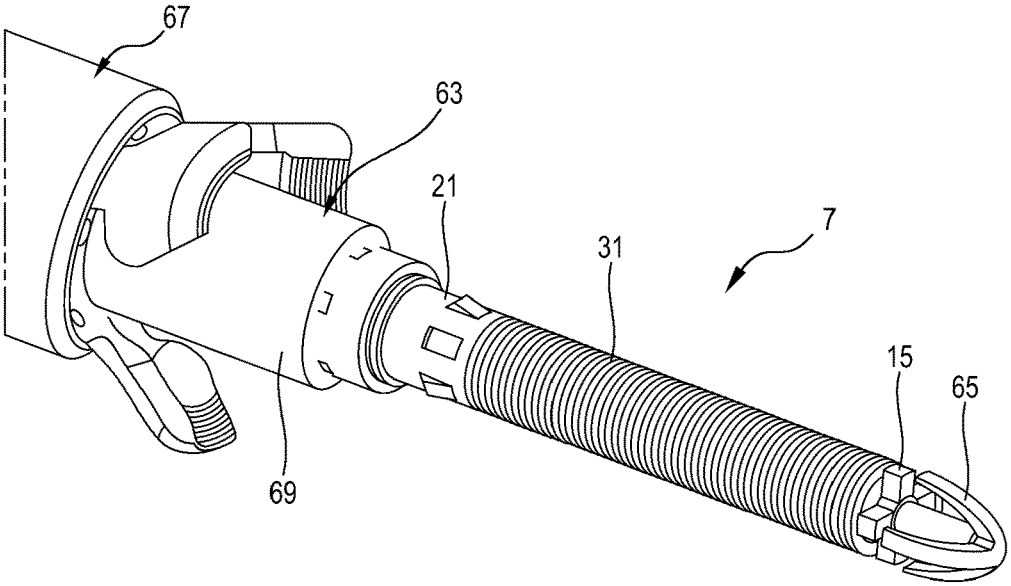
FIG. 33 is a perspective view of another embodiment of the trigger assembly supported by an embodiment of an insertion device of a machine that separately stores a plurality of the boosters and assemblies of the detonation unit body and the detonator housed in the detonation unit body, with the trigger cord interconnecting the detonation unit body and the detonator in each assembly and assembles the components together and positions the assemblies in holes.
Figure 34:
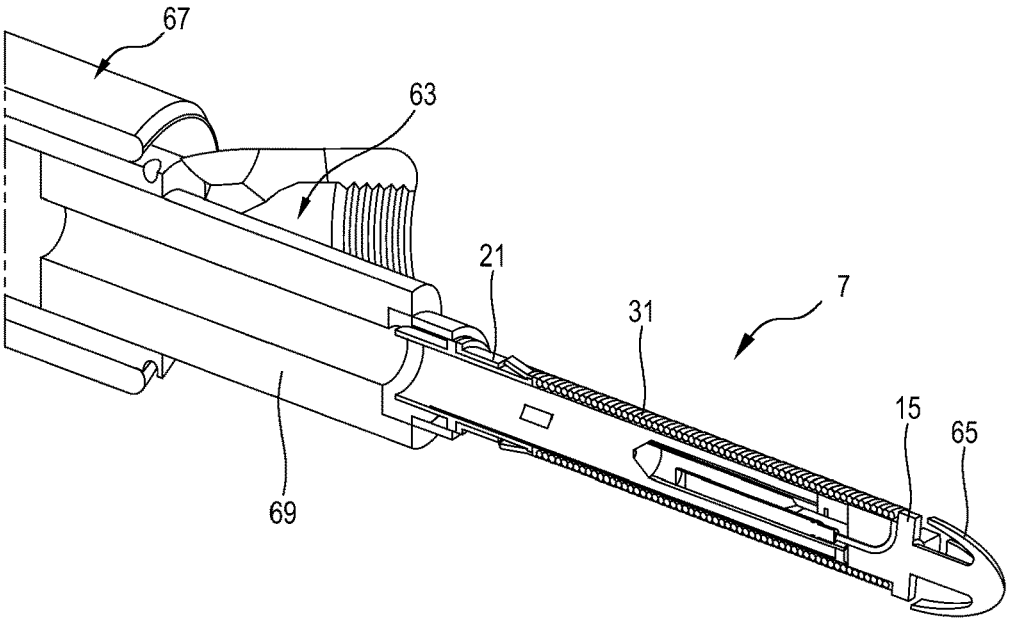
FIG. 34 is a sectional view of the insertion device and the trigger assembly shown in FIG. 33.
Figure 35:
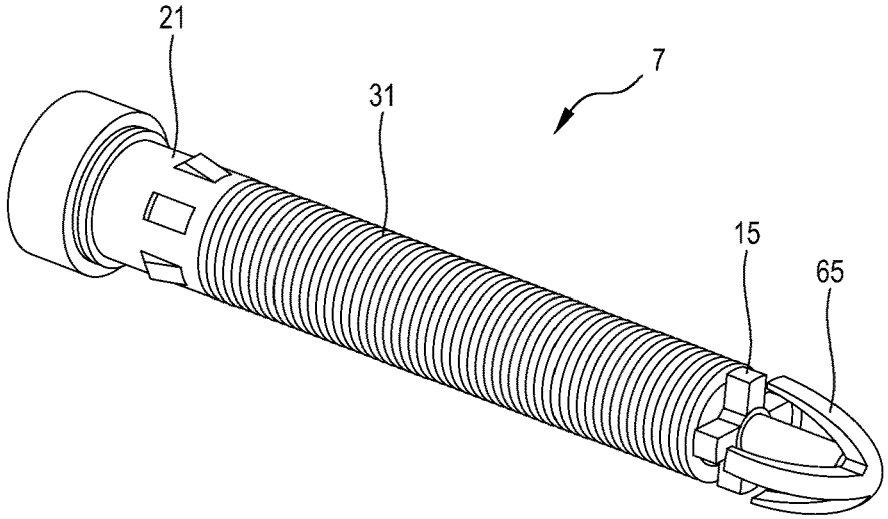
FIG. 35 is a perspective view of the trigger assembly shown in FIGS. 33 and 34.
Figure 36:
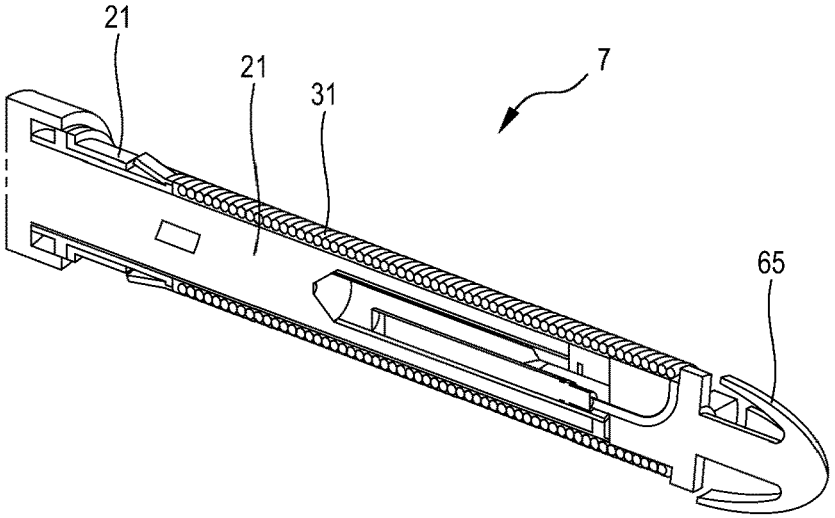
FIG. 36 is a sectional view of the trigger assembly shown in FIGS. 33 to 35, with the booster and the detonator removed for clarity.

FIGS. 28-32 show an arrangement in which a plurality of pre-packaged cartridges 61 of explosives are successively inserted into a hole 9 and move the explosion trigger comprising the booster 19 and the detonator 15 forwardly into the hole 9 to the detonation position form the initial position of the trigger assembly 7 in the hole 9 (as shown in FIG. 32).

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Many modifications may be made to the embodiments of the invention described in relation to the Figures without departing from the spirit and scope of the invention.

By way of example, whilst the embodiments describe that the explosion trigger is housed in the compartment defined by the detonation unit body 21 in the initial position of the trigger assembly in the hole 9, the invention is not confined to this arrangement and extends to other arrangements, such as arrangements in which the explosion trigger is outside the compartment in the initial position of the trigger assembly in the hole 9.

The invention claimed is:

1. An assembly for triggering an explosive in a hole to produce an explosive blast in the hole, the assembly comprising:

(a) an explosion trigger for triggering the explosive in the hole;

(b) a detonation unit body that is configured to be located at or proximate an open end of the hole in an initial position of the assembly in the hole; and (c) a trigger cord that is connected to the detonation unit body and to the explosion trigger, wherein the detonation unit body comprises a mount that receives and supports the explosion trigger in the initial position.

2. The assembly defined in claim 1, wherein the detonation unit body has a compartment for housing the explosion trigger in the initial position.

3. The assembly defined in claim 2, wherein the detonation unit body includes a sleeve that defines the compartment and that is configured to extend into the hole and to receive and support and protect the explosion trigger in the initial position.

4. The assembly defined in claim 3, wherein the mount receives and supports the explosion trigger within the sleeve in the initial position.

5. The assembly defined in claim 1, wherein the detonation unit body includes:

(a) a sleeve that defines the compartment and that is configured to extend into the hole and to receive and support and protect the explosion trigger within the sleeve in the initial position;

(b) a retaining means configured to be located against an exposed face of the rock mass in which the hole is formed for retaining the detonation unit body in the initial position, with the sleeve extending into the hole and the explosion trigger housed within the sleeve in hole; and (c) a connection unit for providing a connection between the trigger cord and an external detonation activation system.

6. The assembly defined in claim 5, wherein the trigger cord is connected at one end to the explosion trigger and at the other end to the connection unit, a length of the trigger cord being selected to be greater than or equal to a spacing between the explosion trigger and the connection unit when the explosion trigger is in a detonation position in the hole.

7. The assembly defined in claim 5, wherein an internal wall of the sleeve of the detonation unit includes a spiral-shaped channel which locates the trigger cord in a spiral arrangement within the sleeve when the assembly is in the initial position.

8. The assembly defined in claim 7, wherein the booster and the detonator of the trigger assembly are separate components in the initial position of the trigger assembly.

9. The assembly defined in claim 5, wherein the detonation unit body includes a formation at a forward end of the sleeve in the direction of insertion of the trigger assembly into the hole that at least partially closes the forward end of the sleeve and prevents forward movement of the explosion trigger and is configured to be detached from the sleeve when a force in excess of a threshold force is applied to the formation.

10. The assembly defined in claim 9, wherein the detonation unit body includes formations on an internal wall of the sleeve that hold the booster within the sleeve so that there is an axial gap between the booster and the detonator in the initial position.

11. The assembly defined in claim 1, wherein the detonation unit body includes a retaining means for retaining the detonation unit body at or proximate the open end of the hole.

12. The assembly defined in claim 11, wherein the retaining means includes a biasing member that is biased to engage a side wall of the hole and to retain the detonation unit body at or proximate the open end of the hole.

13. A method for loading explosives and explosion triggers into holes in a mine face, the method comprising, for each hole:

(a) locating a trigger assembly as defined in claim 1 in the initial position of the trigger assembly;

(b) moving the explosion trigger of the trigger assembly forward from the initial position into the hole to a detonation position of the trigger assembly in the hole; and (c) locating an explosive in the hole.

14. A detonation unit body of a trigger assembly for triggering explosives in a hole, the detonation unit body comprising:

(a) a sleeve configured to extend into the hole and to receive and support an explosion trigger and a trigger cord of the trigger assembly within the sleeve in an initial position of the trigger assembly in the hole;

(b) a retaining means for retaining the detonation unit body at or proximate an open end of the hole in the initial position, with the sleeve extending into the hole and the explosion trigger and the trigger cord housed within the sleeve;

(c) a connection unit for providing a connection between the trigger cord and an external detonation activation system that is connected to the explosion cord; and (d) a mount for receiving and supporting the explosion trigger within the sleeve, wherein a wall of the sleeve comprises a channel for locating the trigger cord when the trigger assembly is in the initial position.

15. The detonation unit body defined in claim 14, wherein the channel is a spiral-shaped channel for locating the trigger cord in a spiral arrangement when the trigger assembly is in the initial position.

16. The detonation unit body defined in claim 14, wherein, in a situation in which the explosion trigger is in the form of (a) a booster containing a small charge of an explosive and (b) a detonator for the small explosive charge in the booster, the detonation unit body includes formations on an internal wall of the sleeve for holding the booster within the sleeve to form an axial gap between the booster and the detonator in the initial position.

17. The detonation unit body defined in claim 14, wherein the channel is formed on an internal wall of the sleeve of the detonation unit body.

* * * * *